US007213661B2

(12) United States Patent
Larsen et al.

(10) Patent No.: US 7,213,661 B2
(45) Date of Patent: May 8, 2007

(54) DUAL PROPERTY HYDRAULIC CONFIGURATION

(75) Inventors: James L. Larsen, Spring, TX (US); Dwayne P. Terracina, Spring, TX (US); Syed Hossain, Spring, TX (US)

(73) Assignee: Smith International, Inc., Houston, TX (US)

( * ) Notice: Subject to any disclaimer, the term of this patent is extended or adjusted under 35 U.S.C. 154(b) by 292 days.

(21) Appl. No.: 10/728,650

(22) Filed: Dec. 5, 2003

(65) Prior Publication Data

US 2005/0121235 A1 Jun. 9, 2005

(51) Int. Cl.
*E21B 10/18* (2006.01)
*E21B 10/61* (2006.01)

(52) U.S. Cl. ..... 175/340; 175/339; 175/393

(58) Field of Classification Search ..... 175/340, 175/393, 339
See application file for complete search history.

(56) References Cited

U.S. PATENT DOCUMENTS 2,855,182 A * 10/1958 Payne ..... 175/340
3,070,182 A 12/1962 Runte
3,087,558 A * 4/1963 Dougherty, Jr. ..... 175/65
3,137,354 A * 6/1964 Crawford et al. ..... 175/340
3,923,109 A 12/1975 Williams, Jr.
4,106,577 A 8/1978 Summers ..... 175/340
4,126,194 A * 11/1978 Evans ..... 175/340
4,185,706 A * 1/1980 Baker et al. ..... 175/340
4,582,149 A * 4/1986 Slaughter, Jr. ..... 175/340
4,687,067 A * 8/1987 Smith et al. ..... 175/340
4,784,231 A 11/1988 Higgins ..... 175/340
5,096,005 A * 3/1992 Ivie et al. ..... 175/340
5,538,093 A * 7/1996 Siracki et al. ..... 175/393
5,601,153 A * 2/1997 Ensminger et al. ..... 175/340
5,853,055 A * 12/1998 Siracki et al. ..... 175/340
6,098,728 A 8/2000 Wells et al. ..... 175/340
6,354,387 B1 * 3/2002 Harris et al. ..... 175/340
6,571,887 B1 * 6/2003 Nguyen et al. ..... 175/57
6,763,902 B2 * 7/2004 Larsen et al. ..... 175/340
2005/0121235 A1 * 6/2005 Larsen et al. ..... 175/340
2005/0217899 A1 * 10/2005 Hossain et al. ..... 175/340

OTHER PUBLICATIONS

International Search Report for Application No. GB0426396.8, dated Jan. 27, 2005 (1 p.).

* cited by examiner

*Primary Examiner*—Jennifer H. Gay
(74) *Attorney, Agent, or Firm*—Conley Rose, P.C.

(57) ABSTRACT

A rotary cone rock bit includes one or more hole cleaning nozzles and one or more bit cleaning nozzles. The hole cleaning nozzles of one drill bit define a projected fluid path disposed at a lateral angle of less than six degrees in order to achieve a large impingement pressure on the hole bottom. The bit cleaning nozzles of the same drill bit define a projected fluid path disposed at a lateral angle of at least six degrees in order to pass within 0.5 inches of the teeth on leading edge of the lagging roller cone. This results in a drill bit that both cleans the bottom hole and cleans cone inserts.

135 Claims, 16 Drawing Sheets

DUAL PROPERTY HYDRAULIC CONFIGURATION

FIELD OF THE INVENTION

The invention generally relates to rotary cone rock bits. More particularly, the invention relates to rotary cone bits having nozzle arrangements to provide cutting structure cleaning and bottom-hole cleaning.

DESCRIPTION OF THE PRIOR ART

Roller cone bits, variously referred to as rock bits or drill bits, are used in earth drilling applications. Typically, these are used in petroleum or mining operations where the cost of drilling is significantly affected by the rate that the drill bits penetrate the various types of subterranean formations. There is a continual effort to optimize the design of drill bits to more rapidly drill specific formations so as to reduce these drilling costs.

Rotary cone rock bits attach to sections of drilling pipe that connect together to form a drill string. A rock bit attaches to the end of this drill string and is rotated, drilling a bore hole into the earth. Rock fragments known as drill cuttings are generated at the bottom of the borehole by the cutting and grinding action of the drill bit rotating at the bottom of the bore hole. These rock fragments are carried uphole to the surface by a moving column of drilling fluid that travels to the interior of the drill bit through the center of an attached drill string, and is ejected from the face of the drill bit through a series of jet nozzles, and is carried uphole through an annulus formed by the outside of the drill string and the borehole wall. The drilling fluid also maintains borehole integrity, and cleans and cools the face of the rock bit.

One design element that significantly affects the drilling rate of the rock bit is the hydraulics. Bit hydraulics can be used to accomplish many different purposes on the hole bottom. Generally, a drill bit is configured with three cones at its bottom that are equidistantly spaced around the circumference of the bit. These cones are imbedded with inserts (otherwise known as teeth) that penetrate the formation as the drill bit rotates in the hole. Generally, between each pair of cones is a jet bore with an installed erosion resistant nozzle that directs the fluid from the face of the bit to the hole bottom to move the cuttings from the proximity of the bit and up the annulus to the surface. The placement and directionality of the nozzles as well as the nozzle sizing and nozzle extension significantly affect the ability of the fluid to remove cuttings from the bore hole.

The amount of energy available at the bit is generally dictated by factors external to the bit such as the drilling rigs' available hydraulic energy, drill pipe type, bottom hole assembly (BHA) configuration and drill depth. However, once the available energy for the rock bit is determined, properly configuring the hydraulics of the bit for the specific application can significantly affect the rate of penetration (ROP) of the bit in the formation.

At a minimum, bit hydraulics must achieve three primary functions to maximize penetration rates and prolong bit life: (1) cutting structure cleaning; (2) bottom hole cleaning; and (3) cuttings evacuation. Cutting structure cleaning removes formation from between teeth or inserts and from between the rows. Bottom hole cleaning allows the cutting structure clear access to undrilled formation. Cuttings evacuation removes drilled formation from the cutting structure/bottom hole zone and up into the annulus. Optimizing for one of these functions may comprise one or more of the others.

The optimal placement, directionality and sizing of the nozzle can change depending on the bit size and formation type that is being drilled. For instance, in soft, sticky formations, drilling rates can be reduced as the formation begins to stick to the cones of the bit. As the inserts attempt to penetrate the formation, they are restrained by the formation stuck to the cones, reducing the amount of material removed by the insert and slowing the rate of penetration. In this instance, fluid directed toward the cones can help to clean the inserts and cones allowing them to penetrate to their maximum depth, maintaining the rate of penetration for the bit. Furthermore, as the inserts begin to wear down, the bit can drill longer since the cleaned inserts will continue to penetrate the formation even in their reduced state. Alternatively, in a harder, less sticky type of formation, cone cleaning is not a significant deterrent to the penetration rate. In fact, directing fluid toward the cone can reduce the bit life since the harder particles can erode the cone shell causing the loss of inserts.

In harder types of formation, removal of the cuttings from the proximity of the bit can be a more effective use of the hydraulic energy than cone cleaning. Cuttings removal can be accomplished by directing two nozzles with small inclinations relative to the center of the bit and blanking the third nozzle (i.e., not having a nozzle at the third location) such that the fluid impinges on the hole bottom, sweeps across to the blanked side and moves up the hole wall away from the proximity of the bit. This technique is commonly referred to as a cross flow configuration and has shown significant penetration rate increases in the appropriate applications. In other applications, moving the nozzle exit point closer to the hole bottom can significantly affect drilling rates by increasing the impact pressures on the formation. The increased pressure at the impingement point of the jet stream and the hole bottom as well as the increased turbulent energy on the hole bottom can more effectively lift the cuttings so they can be removed from the proximity of the bit. A drill bit designer must often decide which of these functions to emphasize at the expense of the others.

Most formations underground are made up of multiple formation types. While optimizing a bit so that it will either keep a cutting structure clean or have good bottom hole cleaning may be satisfactory for many formation types, it would be advantageous to design the hydraulics of the bit such that both bottom hole cleaning and cutting structure cleaning could both be effective simultaneously. While a bit designed primarily toward cone cleaning may be best for one formation type, bottom hole cleaning might be advantageous for another. It would be beneficial to be able to address both conditions during a single run of the bit with one hydraulic configuration; these bits herein after are referred to as dual-property bits.

Prior art bits having hydraulics for both bottom hole cleaning and cutting structure cleaning include U.S. Pat. Nos. 4,106,577; 4,784,231; and 6,354,387. U.S. Pat. No. 4,106,577 teaches a hydromechanical drilling tool which combines a high pressure water jet drill with a conventional roller cone type of drilling bit. The high pressure jet serves as a tap drill for cutting a relatively small diameter hole in advance of the conventional bit. Auxiliary laterally projecting jets also serve to partially cut rock and to remove debris from in front of the bit teeth thereby reducing significantly the thrust loading for driving the bit.

U.S. Pat. No. 4,784,231 teaches a replaceable fluid nozzle for well hole drill bits. The nozzle includes a main discharge port directed downward between adjacent cutting cones of the drill bit, and two side discharge ports directed toward the leading and trailing cutter cone backfaces, respectively. The side discharge ports direct jets of drilling fluid to wash away formation fines and shale packings from around the cutter cone bearing seals. The side jets of fluid remove abrasive particles to prolong the life of the cutter cone bearings and seals.

U.S. Pat. No. 6,354,387 teaches a tri-cone earth-boring bit having nozzles oriented for improved cone cleaning, bottom cleaning and cuttings evacuation. Each of the nozzles is oriented to discharge across a trailing side of a cone at a point considerably inboard of the borehole wall. Each nozzle has an outlet located radially outward from the bit axis a distance that is at least equal to a distance from a top dead center of the heel row of each of the cones to the bit axis. Also, each of the nozzles is oriented to discharge drilling fluid along a line that contacts the borehole bottom at a distance that is no greater than a distance from a bottom dead center of an outermost of the inner rows of the cone to the bit axis. A portion of the drilling fluid discharged from each nozzle will pass by more than one of the rows of the cones.

The above mentioned dual-cleaning bits have inherent deficiencies. For example, in U.S. Pat. No. 4,106,577 the drilling tool requires ultra-high pressurized fluid to actually cut the formation. In the vast majority of drilling applications, pressures of this magnitude (e.g. 15 kpsi) are practical to achieve due to equipment limitations or unavailability. In addition, this design further requires the user to properly orientate and install the removable nozzle for effective performance.

In U.S. Pat. No. 4,784,231 the removable nozzle requires careful and proper orientation of the nozzle body to direct fluid to the desired locations. In addition, this design limits the fraction of fluid directed towards the cone to 10% of the total flow. To achieve this, small orifices are required which lends the design to plugging by lost-circulation material (LCM) that is commonly introduced into the drilling fluid. Moreover, the fluid is directed to toward the cone backface to keep the seal area cleaned, and not the cutting structure.

In U.S. Pat. No. 6,354,387 the design concentrates cleaning efforts on the inner cutting structure rows, rather than the outer cutting structure rows, which is known to be the area of greater need, by having the jet impingement location located radially near the inner rows. Furthermore, the fluid stream is interrupted by the passing of inserts as the cones are rotated, thus reducing the fluid impingement pressure and consequently reducing the hole bottom cleaning effectiveness.

BRIEF DESCRIPTION OF THE DRAWINGS

For a more detailed description of the preferred embodiment, reference will now be made to the accompanying drawings, wherein.

NOTATION AND NOMENCLATURE

Figure 1:
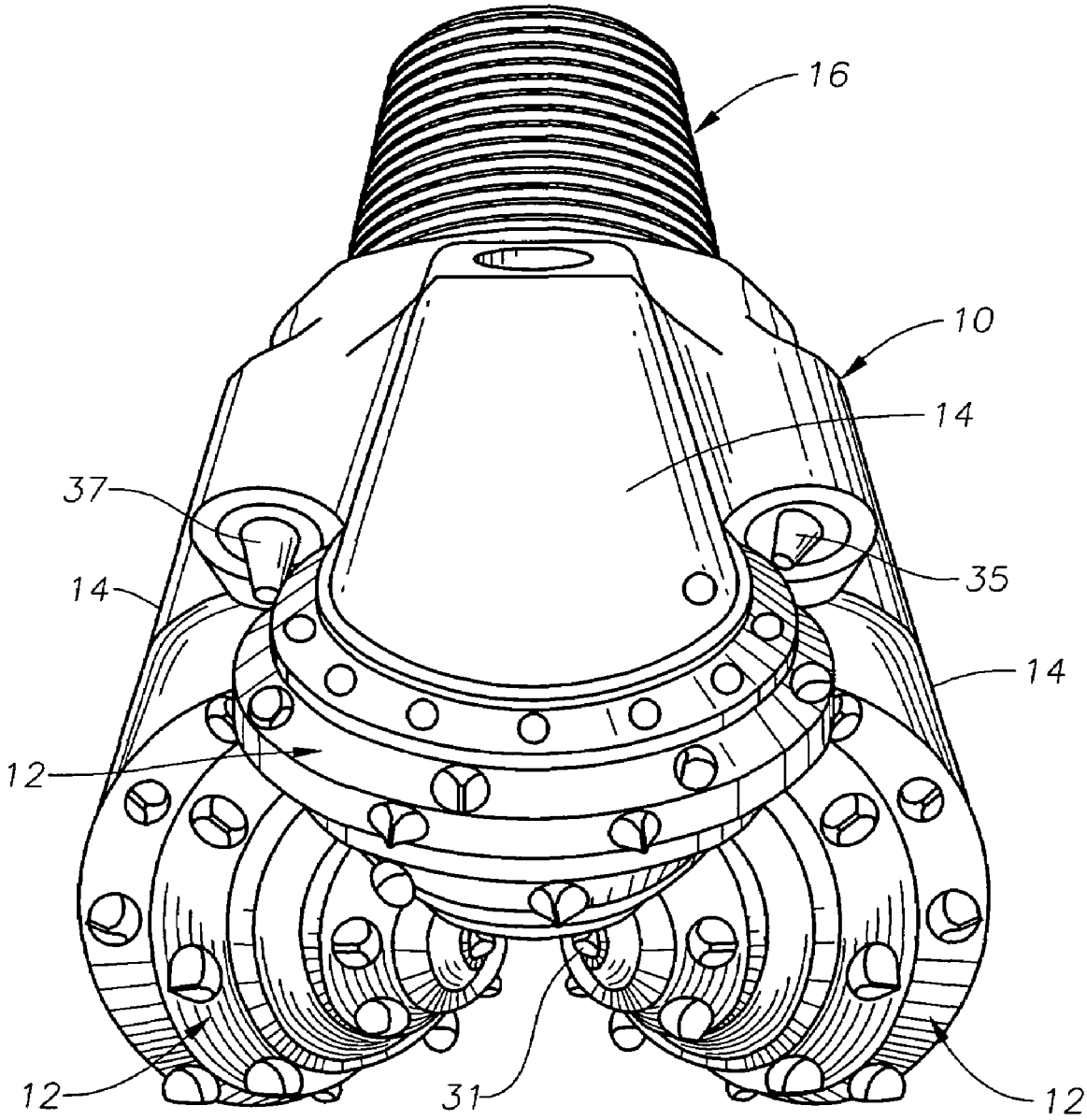
FIG. 1 is a side view of a rotary cone rock bit having three cones in accordance with the principles of the present invention.

Certain terms are used interchangeably throughout the specification. These include hole cleaning, hole bottom cleaning, and bottom hole cleaning. Cutting structure cleaning and cone cleaning are also interchangeable. It is also to be understood that the terms "tooth", "teeth", "insert(s)", and "cutting element(s)" are interchangeable where appropriate. "Vertical" refers to orientation relative to bit, centerline as though the drill bit were drilling vertically.

DETAILED DESCRIPTION OF THE PREFERRED EMBODIMENTS

A more detailed description of the threefold hydraulic function of rotary cone rock bits allows a deeper understanding of reasons for optimizing the hydraulic configuration for the specific drilling application.

Cutting Structure Cleaning

At the very soft end of the formation spectrum there is a strong tendency for clay minerals to adhere to the teeth or inserts of bits. The adhesion of formation to teeth or inserts is commonly referred to as "bit balling". As is known in the art, bit balling describes the packing of formation between the cones and bit body, or between the bit cutting elements, while cutting formation. When it occurs, the cutting elements are packed off so much that they don't penetrate into the formation effectively, tending to slow the rate of penetration for the drill bit (ROP). For example, "gumbo" in the US Gulf Coast area has a sticky nature and adheres to rock bit cutting structures. It must be removed efficiently to maintain reasonable penetration rates. Cone cleaning reduces the problem of bit balling, and thus effective cone cleaning is a desirable feature of bit design.

In harder clays and shales, cuttings can become impacted or "balled up" between the teeth or inserts of the cutting structures. When formation sticks to cones or is impacted between cutting elements it limits insert/tooth penetration. Also, formation packed against the cone-shell closes the flow channels needed to carry other cuttings away. This promotes premature bit wear.

Bottom Hole Cleaning

When the rock being drilled is fractured, the resulting cuttings must be removed before the next insert/tooth is presented to that area on the hole-bottom. Failure to remove cuttings from the hole bottom quickly results in those cuttings being re-drilled, inefficiently using mechanical energy that would otherwise be better used on drilling new formation.

In addition, teeth and inserts penetrating through a layer of fractured cuttings are more likely to have contact between cuttings and the cone-shell of the bit. This could lead to abrasion of the supporting steel resulting in insert loss or tooth breakage.

Hole cleaning nozzles are thus preferably arranged such that the drilling fluid contacts the bore hole bottom with maximum or near-maximum impingement pressure. Five factors that affect impingement pressure include: 1) proximity of the nozzle to the hole bottom; 2) the inclination angle of the fluid relative to the hole bottom; 3) internal nozzle geometry; 4) the global characteristics of the flow domain; and 5) bit body interference.

1) Proximity of the Nozzle to the Hole Bottom

While fluid is within the nozzle bore, it maintains a velocity profile consistent with the total flow area of the bit. For example, a cross-sectional area of the nozzle bore is reduced, the velocity of the fluid increases. The total flow area of the drill bit is determined by summing up all the areas of each nozzle exiting the bit. Once the fluid exits the nozzle bore and interacts with the surrounding fluid in the drilled bore, the fluid velocity of the jet stream begins to slow down. The further the nozzle exit is offset from the hole bottom, the more the velocity of the jet stream will slow down. Since the impingement pressure is directly proportional to the velocity of the fluid as it approaches the bottom of the bore hole, changes is the nozzle distance from the hole bottom will change significantly depending on how close the nozzle exit is to the hole bottom.

Figure 4:
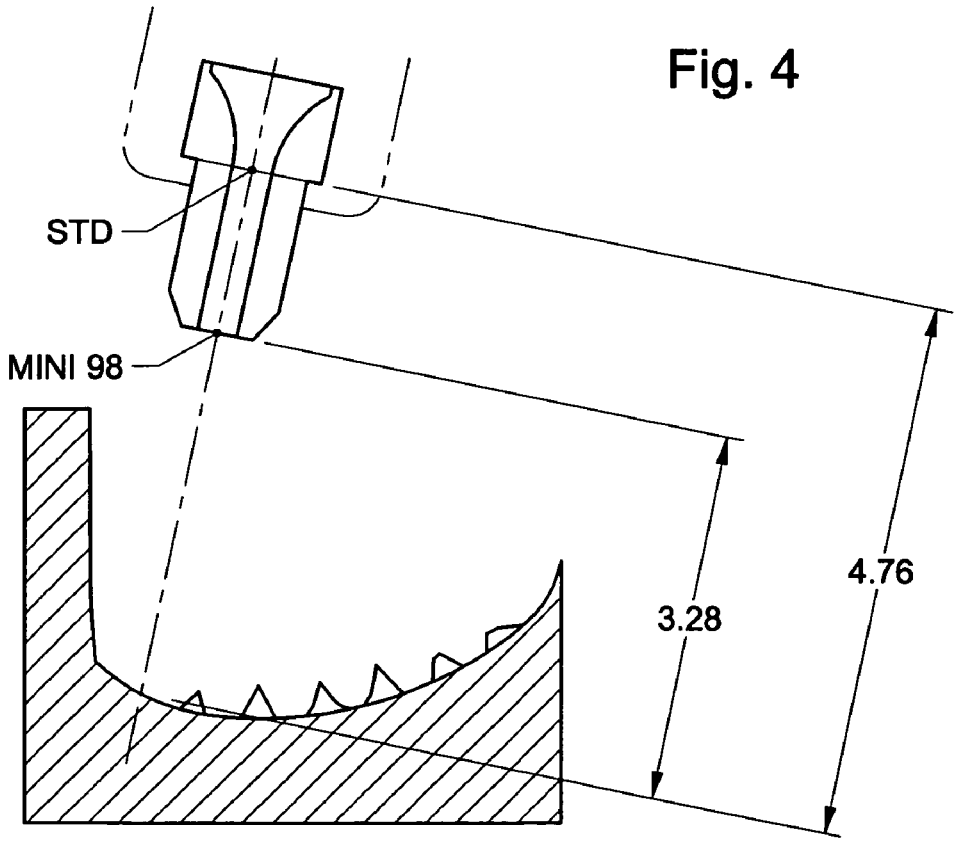
FIG. 4 is schematic drawing of hydraulic configurations used in impingement tests to determine the benefits of nozzle extension.

If the nozzle exit is closer to the hole bottom, less fluid is entrained, resulting in higher energy levels. To determine the effects of nozzle exit proximity on the impingement pressure, a series of tests were run using a 7⅞" non-extended or embedded nozzle (STD) and a 7⅞" mini-extended nozzle (MINI), as shown in FIG. 4. In such a case, the exit point for the non-extended nozzle was 4.76" from the hole bottom along the exit flow trajectory and the exit point for the mini-extended nozzle was 3.28" from the hole bottom along its flow trajectory. The position and angles of the jets were the same for both runs.

Figure 5:
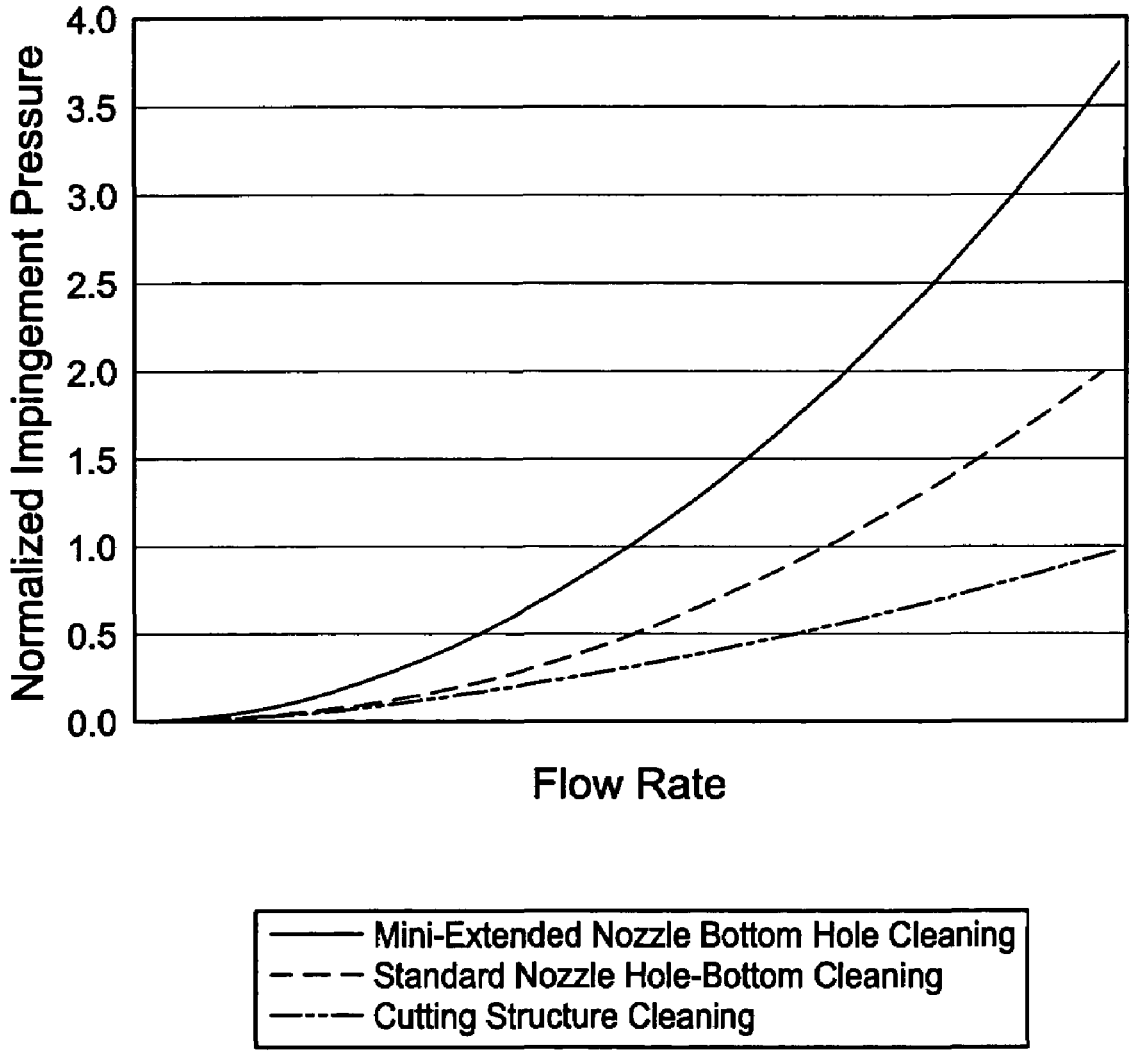
FIG. 5 is a plot of maximum impingement pressure as a function of flowrate for the hydraulic configurations of FIG. 4.

FIG. 5 shows a plot of maximum impingement pressure as a function of flow rate for these nozzle configurations. In FIG. 5, the mini-extended nozzle exhibits a significant increase in impingement pressure by about 100% over the standard nozzle run.

As the lateral angle of the nozzle is increased to improve cone cleaning, the distance to the hole bottom is also typically increased. The increased distance to the hole bottom is one factor that contributes to the reduced impingement pressure on the hole bottom such as when the nozzle is cleaning the cutting structure.

2) Inclination Angle

The bottom impingement pressure is strongly affected by the inclination angle of fluid relative to the hole bottom. As can be appreciated, if the fluid hits the hole bottom at a 90° angle, it fully stagnates, maximizing the impingement pressure. However, as the jet stream angle decreases to less than 90°, the impingement pressure goes down. Thus, for bottom hole cleaning, it is desirable to have inclination angles close to 90°.

3) Nozzle Geometry

The conditioning of fluid in the nozzle can significantly affect impingement pressure. For example, if a diffuser nozzle is used in the jet bore, the fluid will slow down within the nozzle, this lowering the impingement pressure. On the other hand, if a mini-extended nozzle is used, turbulent eddy currents within the fluid will be dampened, minimizing diffusion entrainment as the fluids exits the nozzles and thus raises bottom hole impingement pressures.

4) Global Characteristics of the Flow Domain

Figure 6:
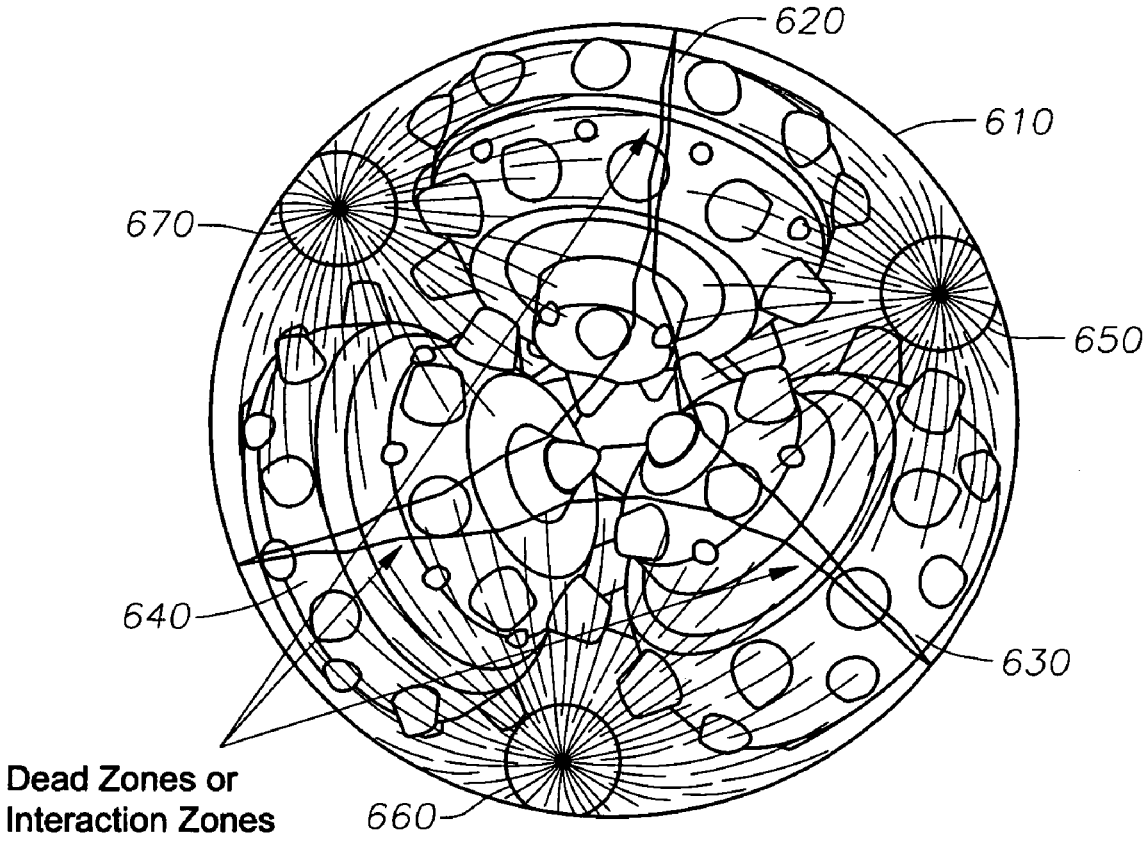
FIG. 6 is a computer-simulation drawing illustrating the flow domain of a rotary cone bit with three nozzles oriented for bottom hole cleaning.

Nozzle orientation can significantly affect the impingement pressure on the hole bottom. FIG. 6 illustrates the bottom hole velocity profile of a bit with three nozzles oriented for bottom hole cleaning. Circular periphery 610 surrounds three cutting cones 620, 630, 640 and the locations for three nozzles 650, 660, 670. Each nozzle passes midway between two adjacent cones and has a very low lateral angle. As is illustrated by flow line 680, as the fluid from each jet impinges on the hole bottom, it moves uniformly from the hole wall and the impingement point in a semi-hemispherical direction. The fluid from each nozzle interacts with fluid from the other nozzles underneath the cones to form interaction zones. Because each interaction zone is displaced a rather large distance from any impingement zone, the three jets have very little effect on each others' impingement pressures.

Figure 7:
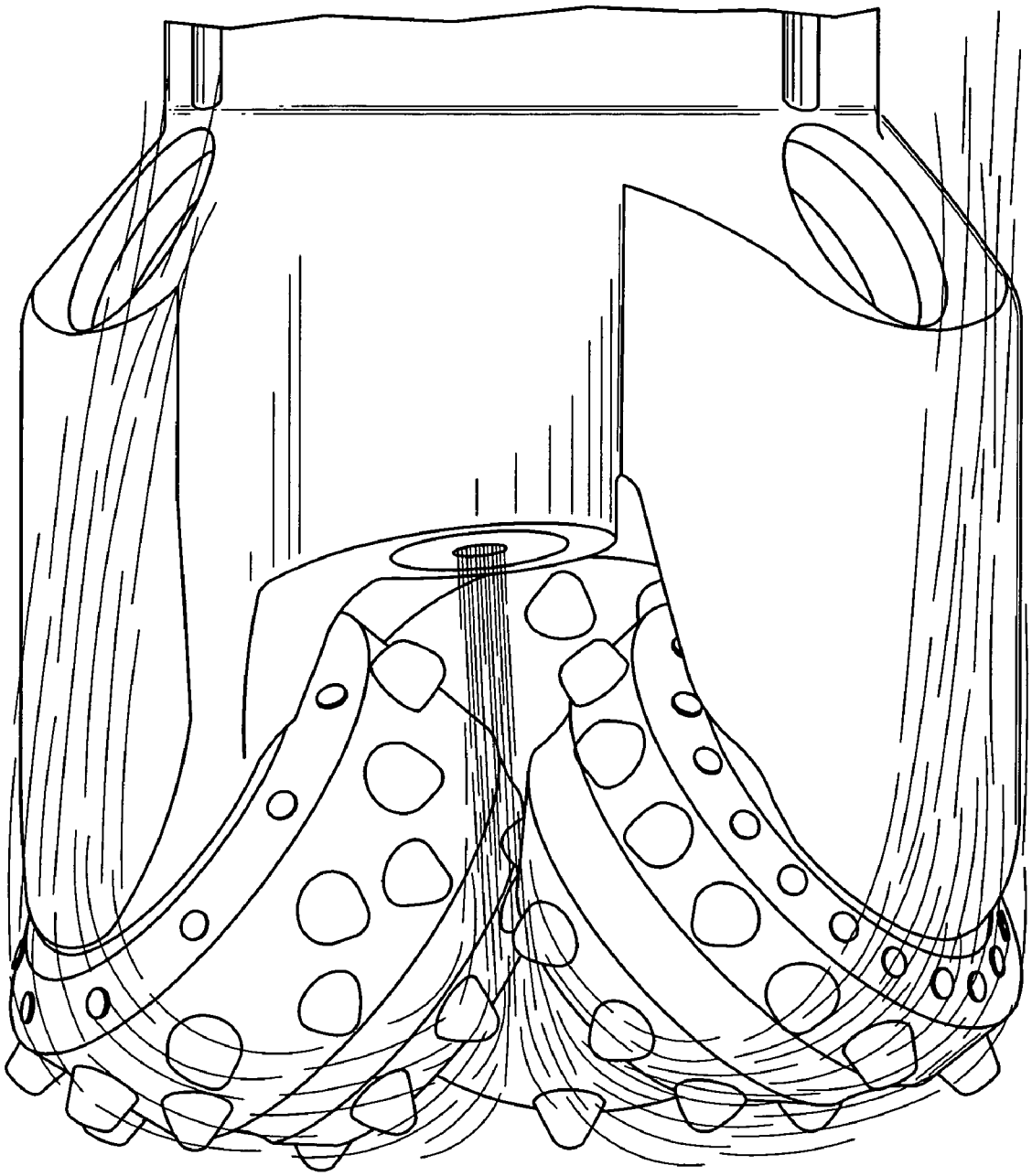
FIG. 7 is a computer-simulation drawing illustrating the side view of FIG. 6.

When the fluid from the two nozzles meet at the interaction zone, the fluid turns either inboard or outboard. Referring to FIG. 7, when a nozzle has a very low lateral angle, the fluid exiting the nozzle moves up the back of the leg as the fluid moves away from the bit.

Figure 8:
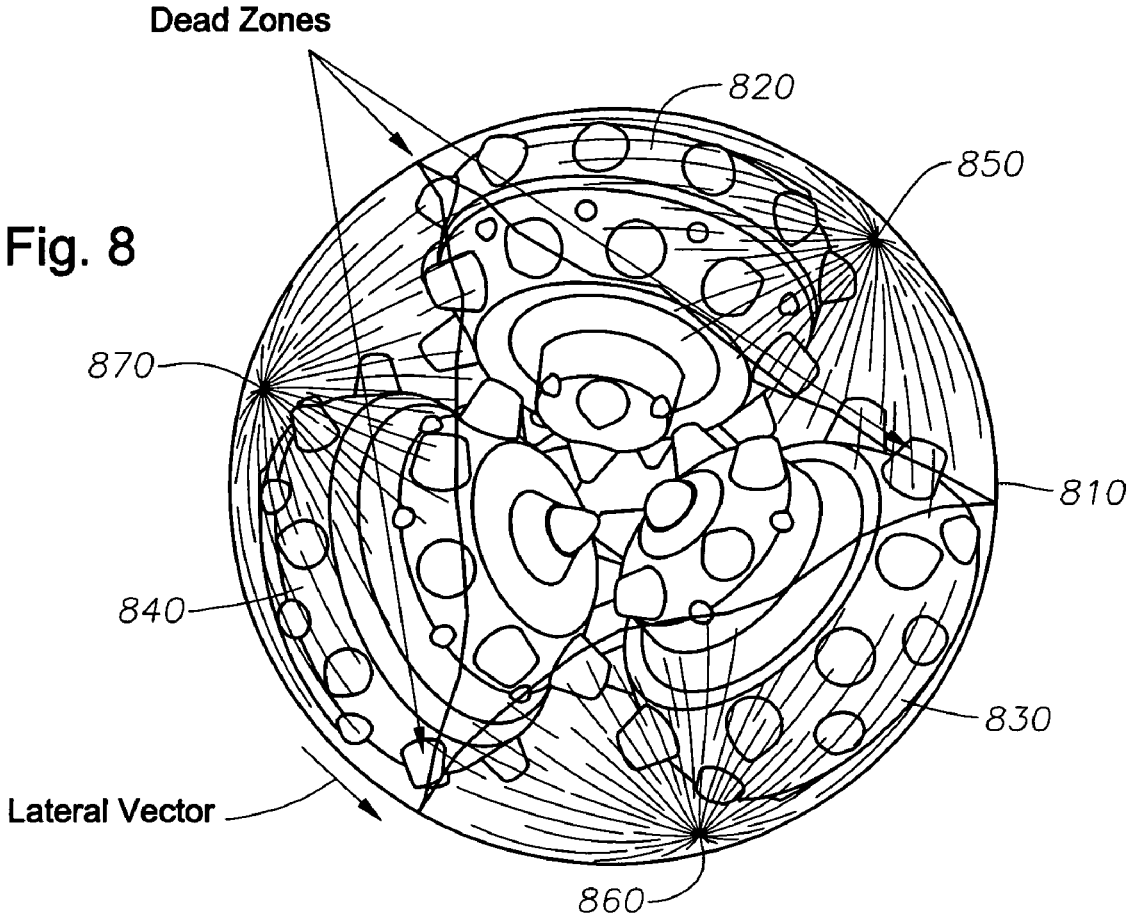
FIG. 8 is a computer-simulation drawing illustrating the flow domain of a rotary cone bit with three nozzles oriented for cutting structure cleaning.

In contrast, FIG. 8 illustrates the bottom hole velocity profile of a bit with nozzles oriented for cone cleaning. Shown in FIG. 8 is a circular periphery 810 surrounding three cutting cones 820, 830, 840. Three locations 850, 860, 870 can also be seen, as well as interaction zones between the nozzles. Each nozzle has a significant lateral angle which causes the interaction zones to become elongated. Because of the close proximity of the interaction, the jets affect each others' impingement pressure by adding a large lateral velocity vector to the jet streams, effectively increasing the angle at which each jet impinges on the hole bottom.

5) Bit Body Interference

Figure 9:
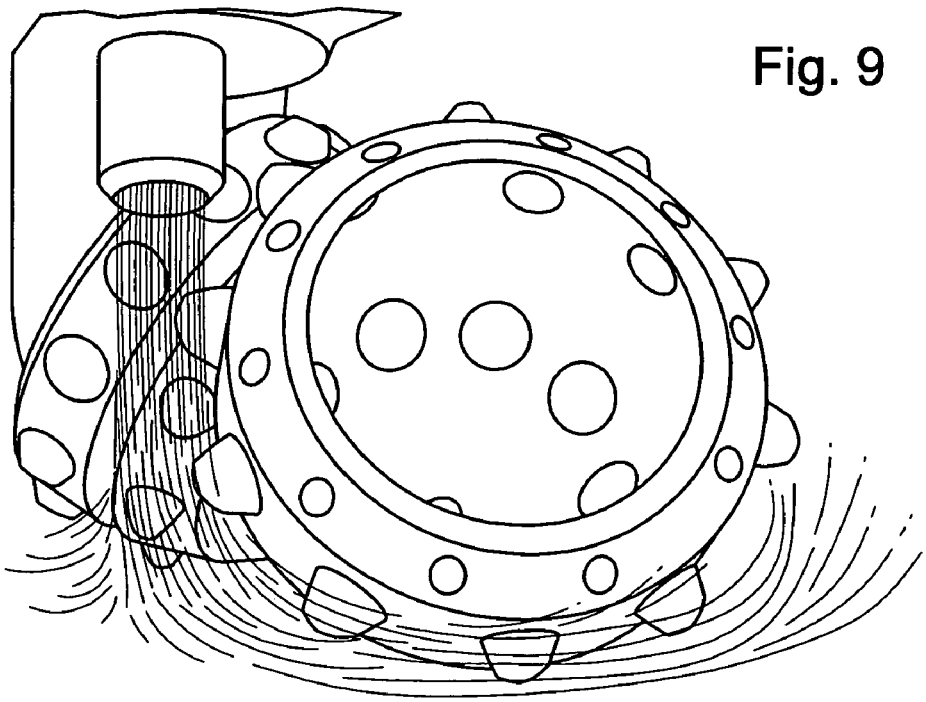
FIG. 9 is a computer-simulation drawing illustrating a fluid stream cleaning a rotary rock cone.

When the nozzle is oriented to clean the cone, the jet stream passes in close proximity to the cone inserts or teeth, as shown in FIG. 9. As the insert passes in and out of the fluid stream, the impingement pressure on the hole bottom fluctuates back and forth resulting in an overall lower average impingement pressure than if the rotating cone were absent. The fluid stream also diffuses as it passes around the inserts.

Cuttings Evacuation

When a cutting is produced, not only must it be removed from the hole bottom and prevented from sticking to one of the cones, but it also must be transported away from the bit/formation interface and into the annulus for transportation to the surface. In very soft and/or sticky formations, failure to evacuate the cuttings efficiently can lead to regrinding or possibly balling of the cuttings with a consequent reduction in ROP. At the other end of the spectrum, in hard and abrasive formations, undesirable return of cuttings to the bit/formation interface causes excessive cone shell erosion and damage to the bit.

A drill bit designed for multiple types of formations must therefore be designed to clean both the cutting structure and the hole bottom while maintaining adequate cuttings evacuation. Bit cleaning nozzles have been arranged so that fluid contacts a particular location at or near the cone shell or cutting elements. Bottom hole cleaning nozzles have been designed so that fluid contacts the borehole bottom with maximum impingement pressure. Referring to FIG. 5, it can be seen that nozzles angled for cutting structure cleaning have a significantly lower impingement pressure than the vertical nozzles used for bottom hole cleaning. This presents a dilemma to drilling bit designers for dual-property drill bits.

The invention proposes inclusion of both a bit cleaning nozzle and a hole cleaning nozzle on a single drill bit. The invention thus combines the benefits of a cone cleaning configuration with that of a bottom hole cleaning configuration. The cone cleaning configuration is desirable for its ability to maintain a clean cutting structure that can fully penetrate into the formation. The helical flow pattern, as shown in FIG. 9, is also desirable in that it minimizes recirculation zones. The bottom hole configuration is desirable for its high impingement pressures that can help lift cuttings from the hole bottom. In particular, for reasons explained below, a preferred three-cone drill bit includes two bit cleaning nozzles between specific pairs of roller cones, and one hole cleaning nozzle between another pair.

A rock bit 10, as shown in FIG. 1, comprises a steel bit body and three cutter cones 12 mounted on legs 14 extending from the bottom of the body. The upper end 16 of the body is threaded and serves as the pin for assembly of the rock bit onto a drill string for drilling bore holes, oil wells or the like. The area between the legs on the underside of the body is referred to as the dome 18 (see FIG. 2). A three leg rock bit is exemplary only and drill bits with other numbers of legs may also be used. A hole cleaning nozzle 37 and a bit cleaning nozzle 35 may also be seen.

Figure 2:
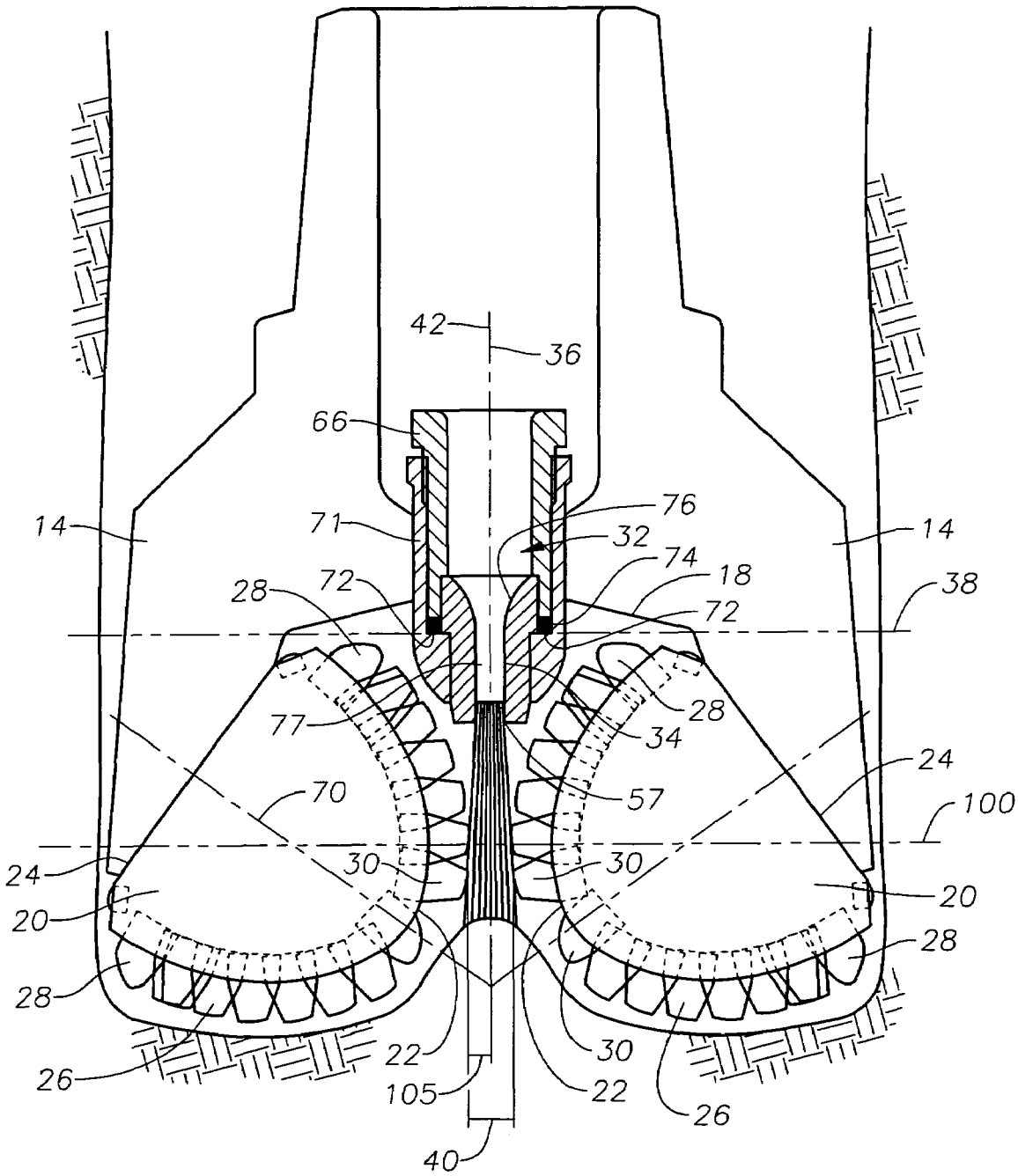
FIG. 2 is a semi-schematic longitudinal cross-sectional view of a rotary cone rock bit having a jet with an extended hole cleaning nozzle and also shows the fluid or mud flow for enhanced cutting removal.

A layout of a three-cone rock bit is shown in FIGS. 2 and 10–12. Referring to FIG. 2, a cutter cone is rotatably mounted on each of the legs 14. A conventional internal structure may be used to mount the cutter cones on the legs. Each cutter cone has a hollow, generally conical steel body 20. The cones have an apex or nose 22 on one end and an opening 24 on the other for receipt of a journal. Each leg has a bearing journal (not shown) extending from its end. Each cone is fitted over the journal, i.e., the journal is positioned inside the cone through the cone's opening. Ball bearings or other cone retention system (not shown) hold the cones on the journals. When mounted on the journals, the cones are radially oriented about the bit central axis so that the nose of the cones is closer to the axis than the opening of the cones.

Cutting elements 26, such as inserts, are pressed into holes or machined on the external surface of the cones. Cutting elements 26 provide the drilling action by engaging subterranean rock information as the rock bit is rotated. The inserts may be any type or shape. For longer life, the inserts may be tipped with a super hard material (e.g. polycrystalline diamond).

The cutting elements are typically arranged in annular rows on the cone. Although nomenclature varies across the industry, the row that cuts the largest diameter within the bore of the hole is referred to as the gage row 28. The next closest row is the row that is referred to as the drive row 26 since this row typically generates the highest torque on the cone. The row closest to the apex of the cone is referred to as the nose row 30. For cones comprising a single central cutting element on their apex, the nose row is the central cutting element.

The drawing of FIG. 2 is schematic in its illustration of the inserts. The inserts are illustrated on each cone in apparently overlapping positions. These inserts represent the inserts on all three of the cones projected around to the planes illustrated. This illustrates the complete coverage of the bore hole bottom by inserts during a complete revolution of the roller cones. In actuality, about ⅓ of the insert rows are on each cutter cone and the insert rows are arranged on the individual cones so that they do not interfere with rows of inserts on the adjacent cones.

Figure 12:
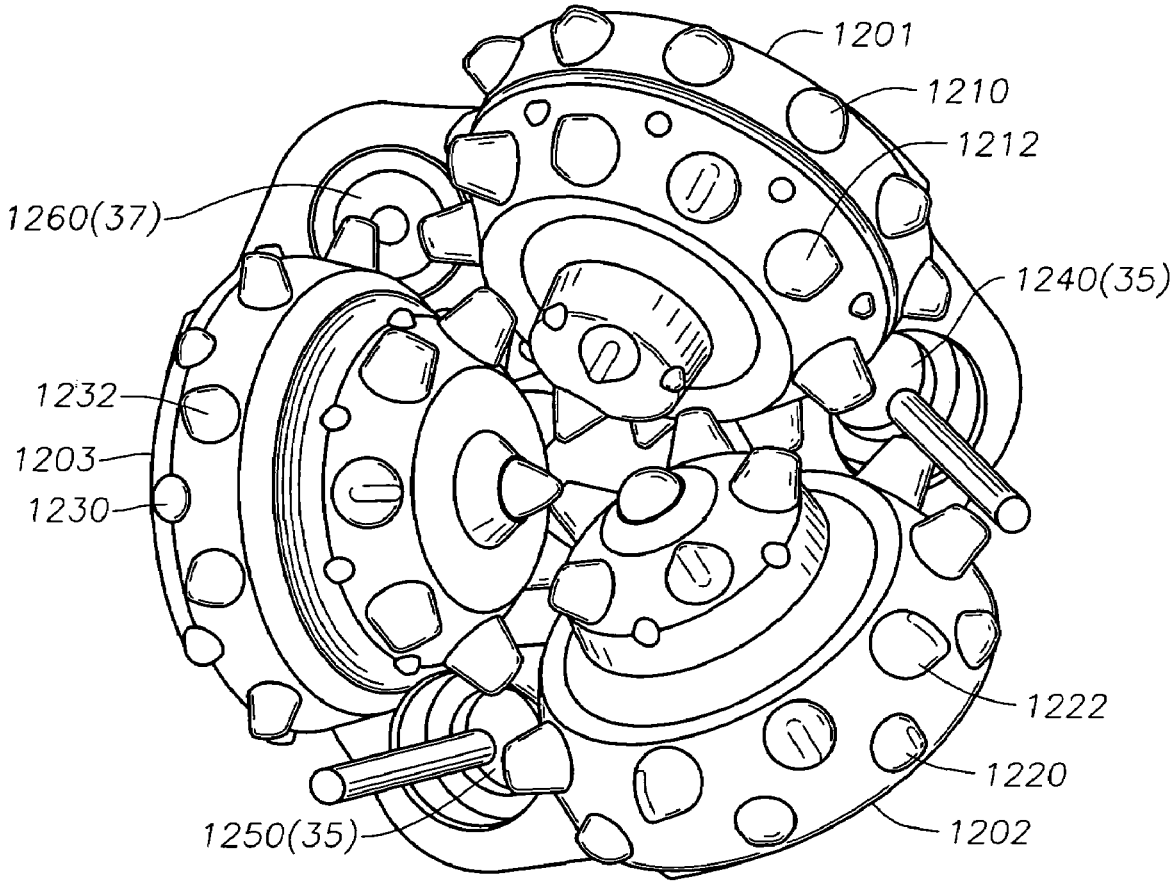
FIG. 12 is a bottom view of a rotary cone rock bit having three jets with embedded nozzles, wherein one nozzle is a hole cleaning nozzle and two nozzles are bit cleaning nozzles, and also shows the projected lines of fluid flow.

The cutting elements may intermesh with each other, as can be seen by reference to FIG. 12. Intermeshing reduces bit balling. As a cutting element of one cone intermeshes between the cutting elements of another cone, it dislodges any balling between the cutting elements. Moreover, having intermesh allows the diameter of the cones to be larger, providing for a larger bearing surface which results in a more durable cone.

Although the invention generally includes peripheral nozzles, and a center jet is optional, the center jet of FIG. 2 can be used to illustrate the general construction of a nozzle and the idea of nozzle clearance. A center jet assembly 32 is located in a nozzle receptacle bit body dome 18. In some embodiments, an outer sleeve 71 is welded into the dome of the bit body. The jet assembly preferably has a nozzle 34 with a shoulder that seats on a shoulder 72 in the sleeve and a jet bore axis (not shown). An inner retainer sleeve 66 is threaded into the outer sleeve for securing the jet against the shoulder. An O-ring 74 seals between the outer sleeve and the jet body to prevent washout around the jet body. For brevity, "jet" as used herein refers to the jet assembly.

In some embodiments, a cylindrical space 40 referred to as nozzle clearance is defined between the cones by the cutting elements. The cylindrical space 40 is not invaded by cutting elements or cones. Cylindrical space 40 provides a path for uninterrupted fluid flow from a center jet hole cleaning nozzle to the bore hole bottom. This cylindrical space has a central axis 42 coaxial with the central axis 36 of the bit. Therefore, the radius 105 of the cylindrical space 40 is equal to the distance from the bit central axis 42 to the closest point touched by the cutting elements on a cutter cone (the cutter cones rotate about their axes 70). In one embodiment, bit central axis 42 is at least 0.3" from the closest cutter element. More preferably, this distance is at least 0.5". Hole cleaning nozzle 32 is positioned accordingly, preferably with the centerline through the central hole cleaning nozzle being coaxial with the bit central axis.

A drill bit may include one or more peripheral nozzles. In the embodiment of FIG. 1, the bit comprises two or more nozzles wherein one or more nozzles is a bit cleaning nozzle 35 and one or more nozzles is a hole cleaning nozzle 37. Whether a nozzle is a bit cleaning nozzle 35 or hole cleaning nozzle 37 according to the invention depends on the nozzle's radial angle, lateral angle, and the distance or clearance between the nozzle bore axis and the closest insert or tooth on the most proximate cone.

Figure 10:
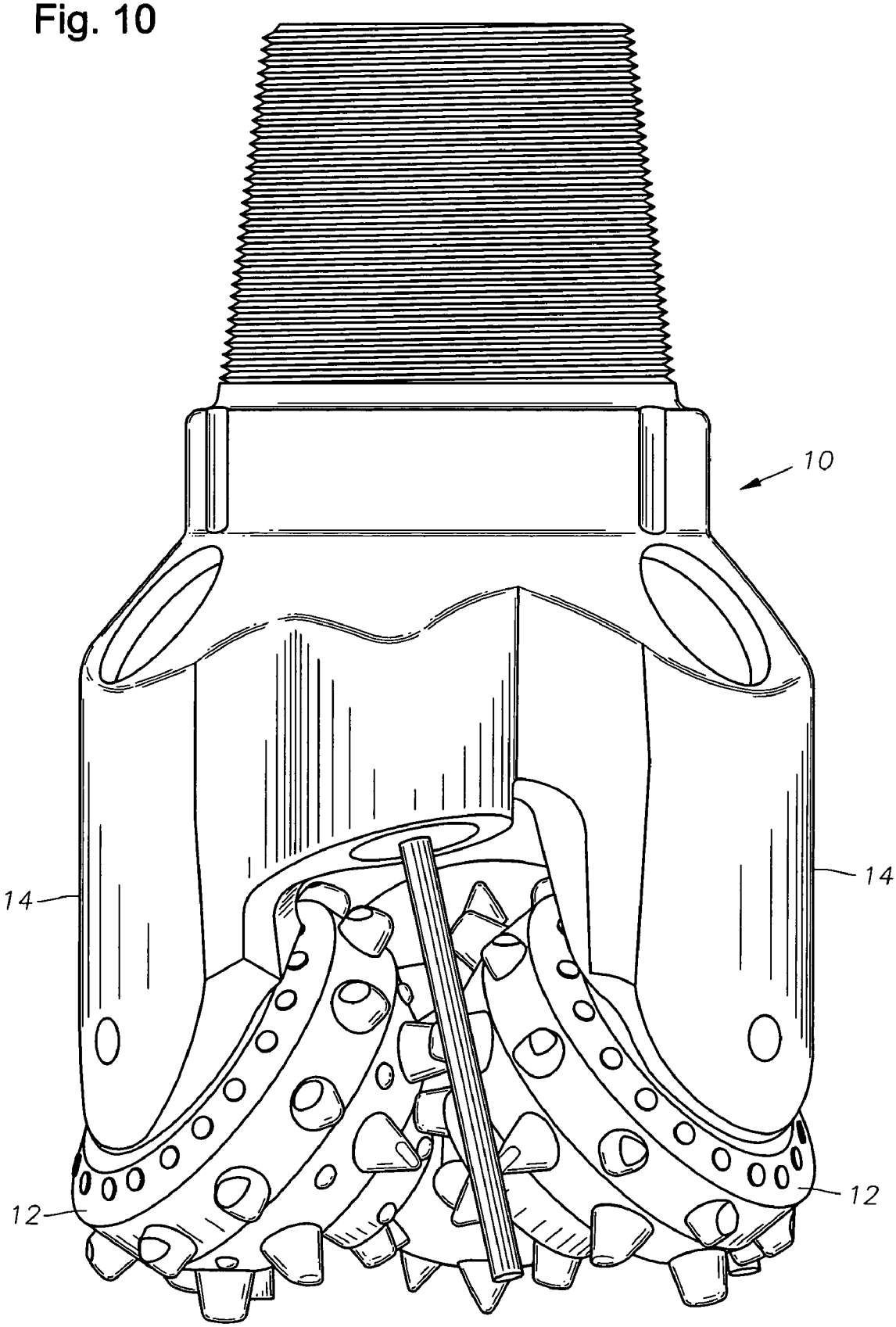
FIG. 10 is a side view of a rotary cone rock bit having a jet with an embedded bit cleaning nozzle and also shows a projected line of fluid flow.
Figure 11:
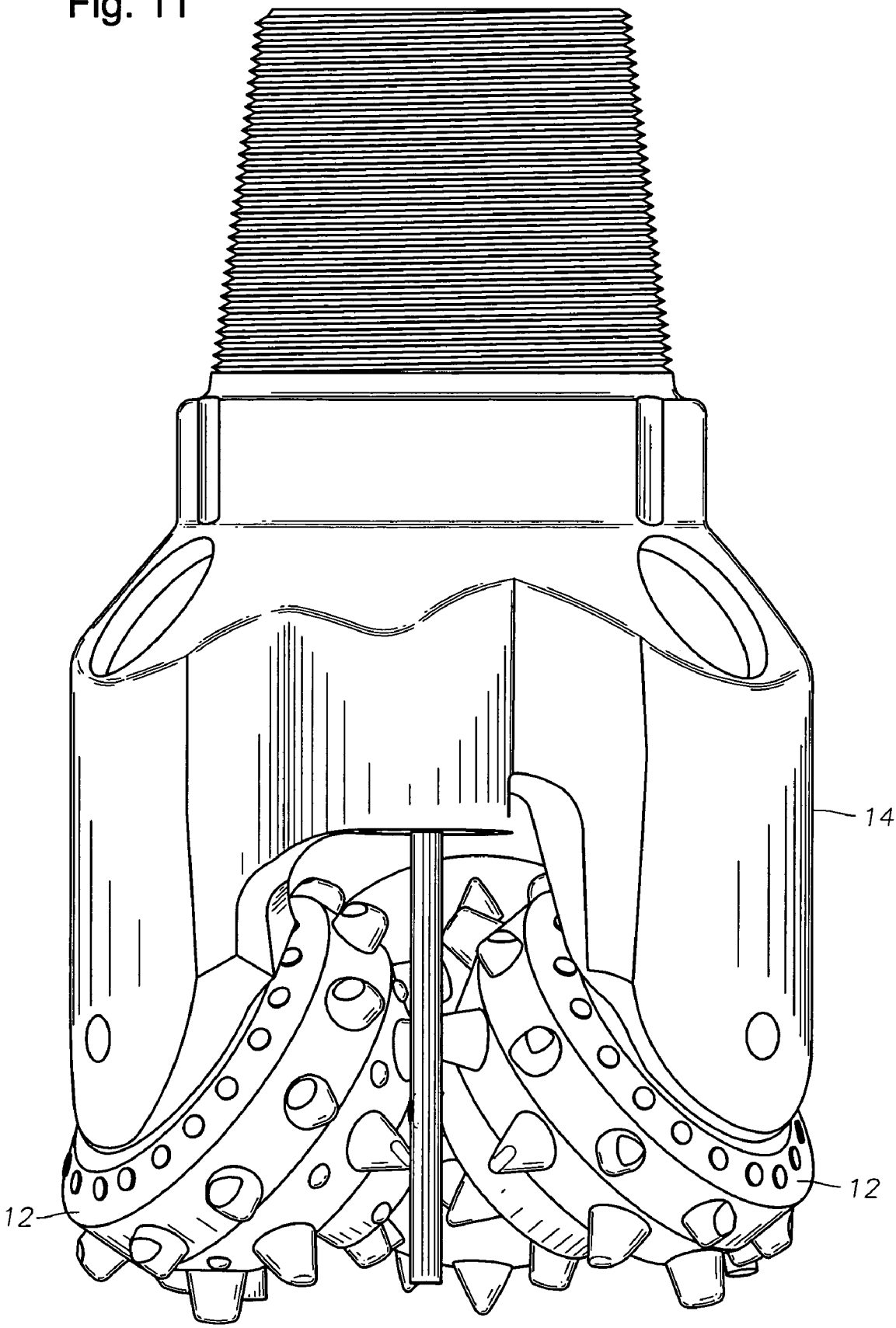
FIG. 11 is a side view of a rotary cone rock bit having a jet with an embedded hole cleaning nozzle and also shows a projected line of fluid flow.

Two bit cleaning nozzles 35 and one hole cleaning nozzle 37 may be advantageously positioned on the dome 18 of a three-cone bit, such that the bit cleaning nozzles 35 and hole cleaning nozzles 37 are each located between two cones. This may be seen better with reference to FIGS. 10–11 (side views of the drill bit of FIG. 1) and FIG. 12, a view of the bottom of the drill bit of FIG. 1. FIG. 10 shows a bit cleaning nozzle. FIG. 11 shows a hole cleaning nozzle. FIGS. 10–12 include a drill bit body and three roller cones 12. Generally, a nozzle is located between each of two adjacent roller cones 12, but multiple nozzles could also be placed between the cones. Although it is to be understood that the jet of fluid ejected from each nozzle behaves in a complicated manner, to simplify understanding of the invention each fluid discharge from bit cleaning nozzles 35 and hole cleaning nozzle 37, respectively, is depicted as a column to emphasize its direction.

The clearance distance from a projected fluid path to a location defined by the closest point on the inserts on the cone is used as a measurement of interest. This clearance distance, combined with the nozzle size and bit size, determines the effectiveness of the nozzle system's ability to clean the inserts. Further, enhanced performance through more effective cone cleaning may result if the projected fluid path passes close to more than one row of inserts, although this is not crucial to the invention in its broader forms.

To understand the cleaning action that occurs downhole, a set of reference terms should be established. The degree of cone cleaning (as well as the risk of cone shell erosion) generally corresponds to the distance between a point relative to the roller cones on the drill bit and a point or area of the jet of drilling fluid ejected from the nozzle. With regard to the roller cones, the cones (and the cutting elements) constantly rotate and move. Nonetheless, the measurement location of interest on the fluid jet is the projected fluid path for the fluid. The measurement location on the roller cone of particular interest is the closest point attained by tips of the cutting elements to the projected fluid path.

Figure 3A:
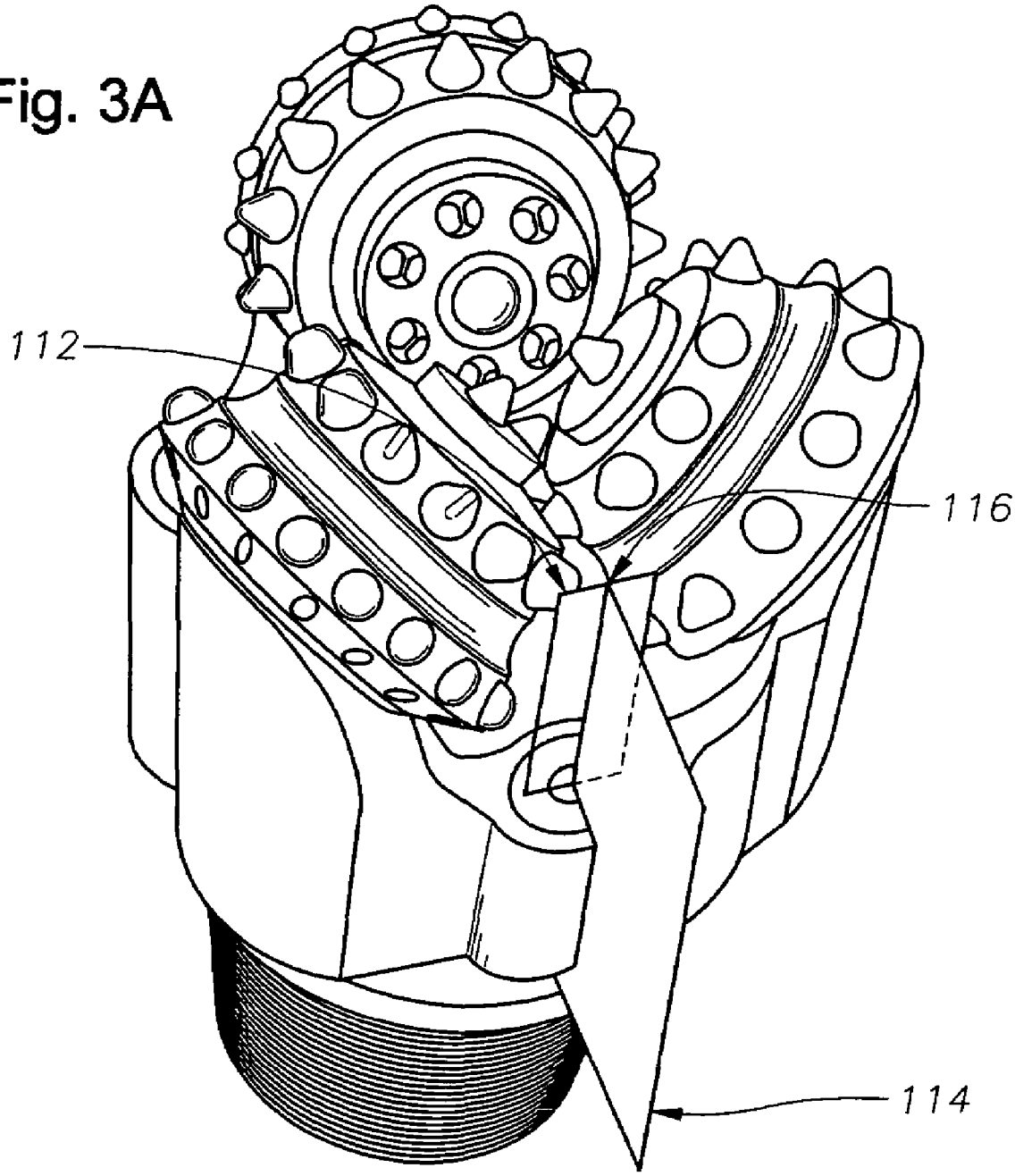
FIGS. 3A–3E are reference schematics defining directional angles for the nozzle.

Referring back to FIGS. 10–12, each nozzle may be tilted by a lateral angle and a radial angle. FIG. 3A helps to define these lateral and radial angles. Referring to FIG. 3A, a three-cone rock bit is shown having two planes, a radial reference plane 112 and a lateral reference plane 114 intersecting 116 on bit body dome 18. Lateral reference plane 114 and radial reference plane 112 are normal to each other and each is parallel to the bit centerline. The lateral angle is the projected fluid path to lateral reference plane 114. The radial angle is the projected fluid path to radial reference plane 112.

Figure 13:
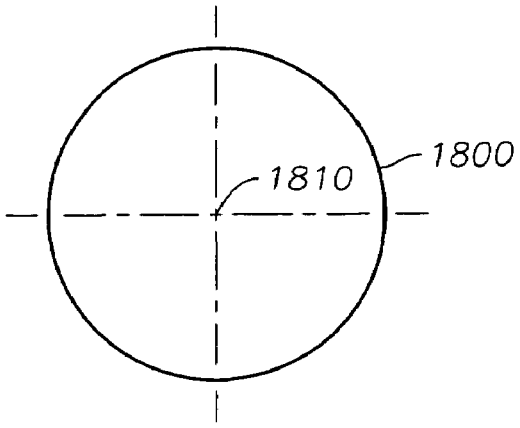
FIG. 13 is a straight-ahead view of a circular exit port.
Figure 14:
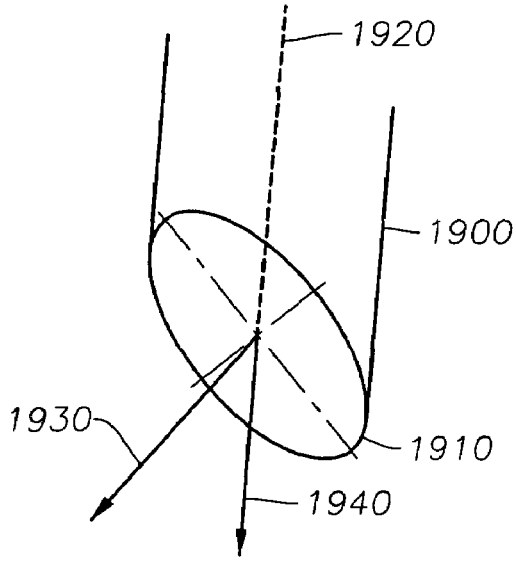
FIG. 14 is a view of an angle exit port showing projected fluid paths.

A geometric parameter called the "projected fluid path" may be found in one of three ways. First, the "face normal projected fluid path" is a line projected normal to the exit surface of an exit port to the nozzle or the nozzle receptacle. For example, as shown in FIG. 13, if a nozzle has a circular exit port 1800, the centroid 1810 of the circle defined by the exit port is the center of the circle. The projected fluid path for this calculation would be a line perpendicular to the center of this circle (i.e. coming straight out of the page), regardless of the angle at which this circle is disposed to the longitudinal axis of the nozzle. For example, FIG. 14 shows a nozzle 1900 with an exit port 1910 disposed at an angle relative to the nozzle. The face normal projected fluid path 1930 is perpendicular to the angular face of the exit port. In the case of an oval-shaped exit port for the nozzle, the centroid of the oval is its center: For more complex exit area shapes, the centroid can be calculated mathematically by equating moments of area or through the use of a CAD system.

A second way to determine the projected fluid path is the "parallel to nozzle centerline projected fluid path". This is a line projected from the centroid of the nozzle exit plane parallel to the centerline of the nozzle. For this calculation, a line projects from the centroid of the exit surface of the nozzle in a direction parallel to the nozzle axis centerline. Obviously, where a straight nozzle is disposed at a near-vertical angle, with the exit plane of the nozzle being perpendicular to the fluid flow (as is typical), these two projected fluid paths are the same. For the geometry shown in FIG. 13, the parallel to nozzle centerline projected fluid path is the same as the face normal projected fluid path. In FIG. 14, the parallel to centerline projected fluid path 1940 is different from the face normal projected fluid path 1930.

A third way to determine a projected fluid flow path is both the most accurate and the most complicated. Termed the "projected average fluid path", it takes into account the fluid behavior in order to determine directionality. To accomplish this task, some knowledge of the flow field is required through means such as computational fluid dynamics (CFD) and/or experimentation. Experimental methods for obtaining flow field data include laser velocimetery, probes, visual observation or other techniques. Typically however, these methods are usually quite expensive and time consuming. CFD, on the other hand, is particularly well suited for this type of analysis since direction and speed of the fluid can be readily determined within discrete elements in the flow field. For instance, the directionality of fluid at a nozzle exit can be determined by evaluating each element or sub-element (i.e. a face or node) of the fluid at the exit plane or exit surface of the nozzle. The first step is to combine all the directionality information of each individual element or sub-element of the nozzle exit into a form that is representative of all the fluid flowing through the nozzle exit. Known approaches include the basic arithmetic average to more complex calculations such as area-weighted averages, velocity-weighted averages, mass-weighted averages, and location-weighted averages. While each method provides an "average velocity vector" result, the nature of the flow field and how the flow field data was generated, may have significant effect on the similarity of the final results. To this end, the preferred method of calculation is by the mass-weighted average velocity vector, $\vec{V}_{AVG}$, as shown below.

$$\vec{V}_{AVG} = \frac{\int \vec{V}\rho\vec{V}\cdot d\vec{A}}{\int \rho\vec{V}\cdot d\vec{A}} = \frac{\sum_{i=1}^{n} \vec{V}_i\rho_i\vec{V}_i\cdot d\vec{A}_i}{\sum_{i=1}^{n} \rho_i\vec{V}_i\cdot d\vec{A}_i} \tag{1}$$

where, $\vec{V}_{AVG}$=Mass-weighted average velocity vector of the fluid flowing through the nozzle exit.

$\vec{V}$=Fluid velocity vector at an arbitrary location on the nozzle exit surface.

$d\vec{A}$=Elemental area of the nozzle exit surface at the arbitrary location.

ρ=Density of the fluid.

i=Subscript denoting element number, ranges from 1 to n.

n=Total number of elements on nozzle exit surface.

$\vec{V}_i$=Velocity vector at element i.

$\rho_i$=Fluid density at element i.

$d\vec{A}_i$=Surface area of element i.

The fluid directionality is then defined as the unit vector of the average velocity vector. It is calculated by dividing the average velocity vector by its magnitude. To measure the angle between the average velocity unit vector and bit centerline, a unit vector describing the bit centerline has to be calculated. Customarily, it is assumed that the positive direction of one coordinate axes in a Cartesian system follows the bit centerline towards the hole bottom. Hence, the bit centerline unit vector lies on one of the principal axis. However, it is not mandatory to do so. Thus the unit vector of the average velocity vector is defined as $$\hat{u}_{AVG} = \frac{\vec{V}_{AVG}}{\|\vec{V}_{AVG}\|} \tag{2}$$

and the bit centerline unit vector is defined as $$\hat{u}_{CL}$$

Where, $\hat{u}_{AVG}$=Unit vector of the mass-weighted average velocity vector of fluid flowing through the nozzle exit.

$\hat{u}_{CL}$=Unit vector describing the bit centerline directed towards the hole bottom.

A vector analysis "dot product" can then be performed on the two unit vectors to determine the angle between the bit centerline and the average velocity vector.

$$\theta=\cos^{-1}(\hat{u}_{AVG}\cdot\hat{u}_{CL}) \tag{3}$$

Where, $\theta$=Angle between the bit centerline unit vector, $\hat{u}_{CL}$, and the average velocity unit vector, $\hat{u}_{AVG}$.

Using this information, the preferred projected average fluid path is defined in this case by projecting the geometric centroid of the nozzle exit surface in a direction defined by the unit vector of the mass-weighted average velocity vector. Alternatively, the mass flow centroid can also be used as a starting point. It would be calculated in similar fashion as the geometric centroid, except the mass flow rate would be used as the basis to determine the centroid location instead of the physical exit area. The possible scenarios for vertical flow include: 1) both projected fluid paths and projected average fluid paths are parallel to bit centerline; 2) face-normal projected fluid path is not parallel to bit centerline, but average fluid path is parallel to bit centerline; and 3) face-normal projected fluid path is not parallel to bit centerline, average fluid path is not parallel to bit centerline, but at least a portion of the fluid is directed in such a way to provide vertical flow. The first instance of vertical flow might be accomplished by attaching a standard mini-extended nozzle to the drill bit body. The second instance of vertical flow might be accomplished by attaching a standard mini-extended nozzle with an exit port truncated to the interior passage of the drill bit rather than perpendicular to the interior passage. The third instance of vertical flow might be accomplished by a lobed or multi-orifice nozzle.

In addition, the shape of the discharge port may vary. For example, the discharge port may be a circle, an oval, an ellipse, a slit, a horseshoe shape, or any other suitable shape. For unusual shapes of the discharge port, determination of a centerpoint for the fluid column may be made by determining the centroid of the discharge port and projecting it along an axis created by the exit flow angle by methods known to one of ordinary skill in the art. Measurement from the closest point attained by the tip of an insert to the fluid column centroid may then be made.

Figure 3B:
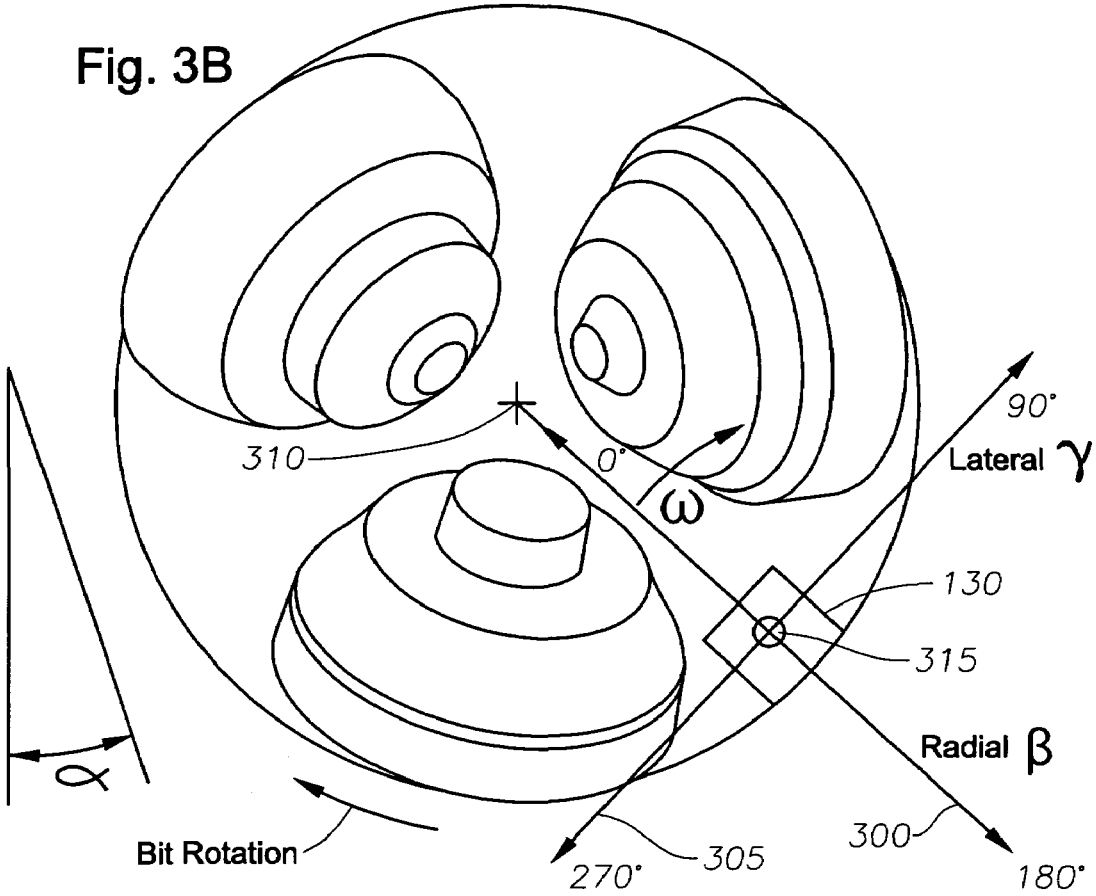

A three cone rock bit preferably includes three nozzles installed in three nozzle receptacles. For a "standard" nozzle or standard mini-extended nozzle or for another nozzle with a straight bore that ejects fluid along the nozzle centerline, angular offset may conveniently be defined prior to nozzle installation and with regard to the nozzle receptacle. One aspect of the invention is therefore the angles for nozzle receptacles located on the face of the drill bit body. Referring to FIG. 3B, a top-down reference diagram is shown that defines the angular offset of a nozzle receptacle. This diagram is not drawn to scale, but includes a drill bit 100 having three roller cones. Point 310 defines the centerline of drill bit 100, while point 315 defines the center of the nozzle receptacle at its exit. FIG. 3D show the position of point 315 lies at the intersection of the receptacle centerline 317 and the exit surface of the nozzle receptacle 318. Referring back to FIG. 3A, a reference line parallel to the longitudinal axis of the drill bit runs through point 315. The radial reference line 300 defines the direction of the borehole wall directly away from the drill bit 100. The lateral reference line 305 is perpendicular to radial reference line 300. A lateral vector is positive when it points generally in the direction of bit rotation and generally toward the leading cone. Conversely, a lateral vector is negative when it points generally against the direction of bit rotation and toward the lagging cone. The invention includes projected fluid paths at both positive and negative lateral angles. The radial reference line intersects point 310 in the center of the drill bit 100, and intersects a lateral reference line at point 315. A radial vector is positive when it points outward, toward the borehole wall. A radial vector is negative when it points inward toward the bit centerline. Thus, each canting or direction of a nozzle receptacle (and therefore the straight nozzle) may be defined as being some combination of a radial vector and a lateral vector.

Figure 3C:
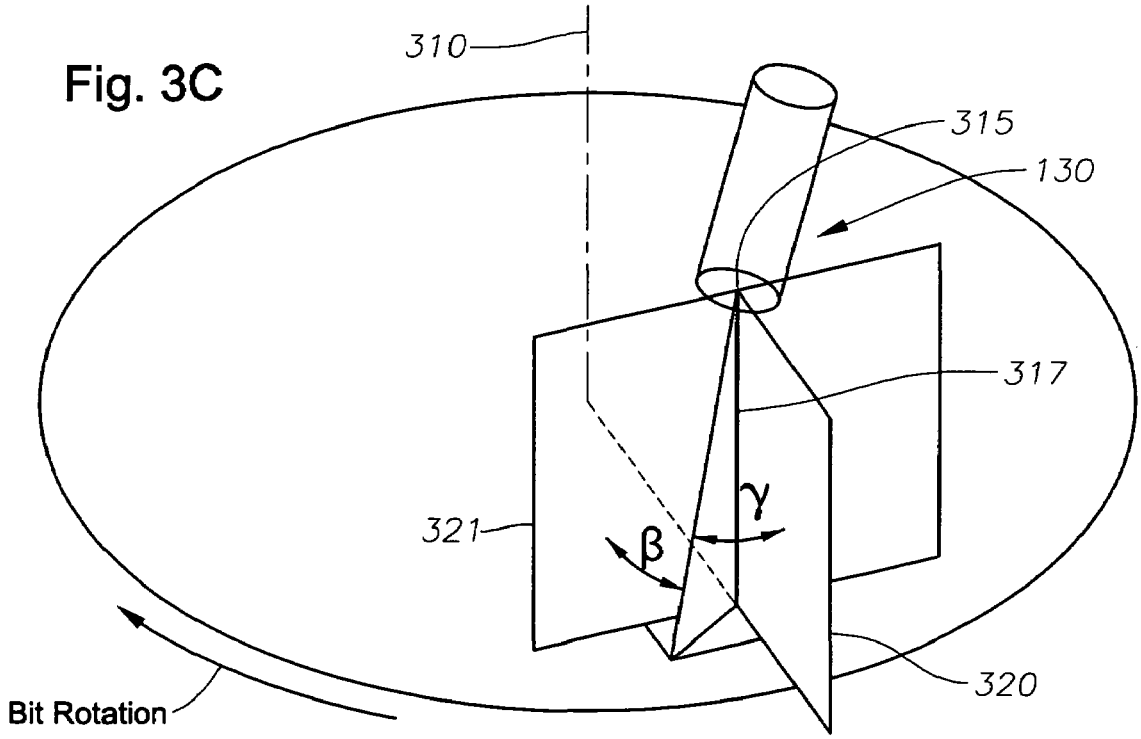
Figure 3D:
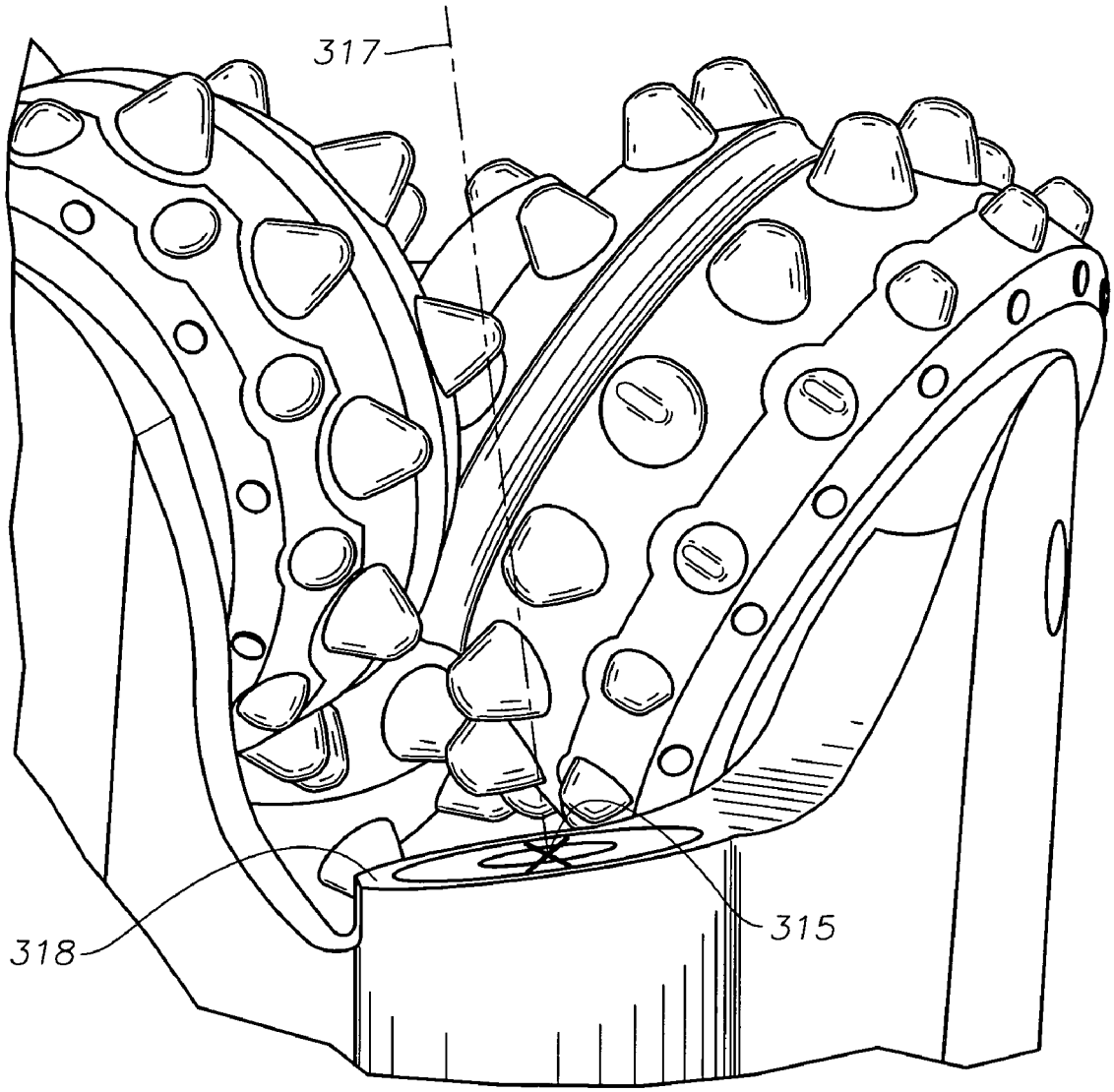

One example of this is shown in FIG. 3C. A nozzle receptacle 130 is shown in FIG. 3C, with the direction of its nozzle being defined by two vector angles, $\gamma$ and $\beta$. The angle $\gamma$ is a lateral angle defined with respect to a first plane 320. Plane 320 is formed by the bit centerline 310 and nozzle receptacle reference line 317. Nozzle reference line 317 is parallel to bit centerline 310 and travels through the point 315 located at the center of the nozzle receptacle exit surface. Positive $\gamma$ angles direct the fluid in the direction of rotation of the bit while negative $\gamma$ angles direct the fluid against the rotation of the bit. A $\gamma$ angle of zero degrees directs the fluid within the radial reference plane 320.

The angle $\beta$ is defined by a second plane 321 that lies perpendicular to the first plane 320 and that intersects the first plane at 317, the nozzle receptacle reference line. In other words, the radial angle $\beta$ may be referenced from a side view of the nozzle. Positive $\beta$ angles direct the fluid in the direction of hole wall while negative $\beta$ angles direct the fluid toward the center of the bit. A $\beta$ angle of zero degrees directs the fluid within the lateral reference plane 321. When both the $\gamma$ and $\beta$ angles are zero degrees, the drilling fluid is directed parallel to the center line of the bit and generally normal to the hole bottom.

In addition to a definition with respect to the nozzle receptacle, angular offset may also be described with respect to the nozzle bore. This is especially effective when non-standard nozzles are used such as curved nozzles as shown in FIG. 3E.

Figure 3E:
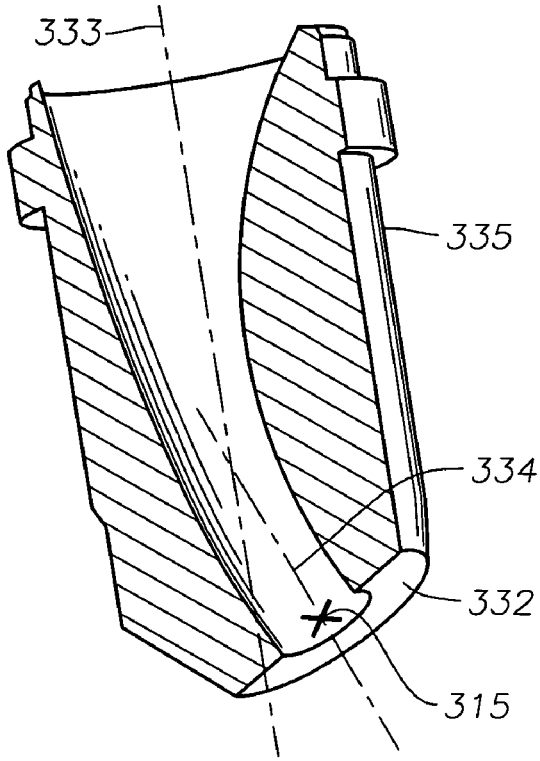

Describing the points and planes of interest may be accomplished with respect to FIGS. 3B and 3E. In this case, point 315 defines the centroid of an exit surface for a nozzle. Point 315 and bit axis 310 define a radial plane. A second plane perpendicular to the first, the lateral plane, is defined by a translated line parallel to the bit centerline and running through the centroid point 315 of the nozzle exit. When the nozzle body 335 is installed in the nozzle receptacle (not shown), nozzle axis 333 is aligned with the axis of the nozzle receptacle. However, since the fluid changes direction as it moves through the nozzle, the fluid direction will exit from the nozzle in a direction generally aligned with exit bore axis 334. This is also perpendicular to the nozzle exit surface 332. A projected fluid path may then be calculated from the exit surface 332 of the nozzle in the same manner as is calculated from the nozzle receptacle, described above.

Cone cleaning nozzle 35 is preferably arranged such that the fluid contacts the cutter elements of the cones at a leading side of the lagging cone. The row or rows of interest are generally on or near the outer portion of the cone, but does not necessarily need to be the gage row. Jet nozzles designed for cone cleaning, such as nozzle 35, have projected fluid paths disposed at large lateral angles. A nozzle would constitute a cone cleaning nozzle if it has a bore with a lateral angle of 6 degrees or larger. More preferably, the nozzle bore should have a lateral angle of 8 degrees or larger. Even more preferably, the nozzle bore would have a lateral angle of 10 degrees or larger. If the jet nozzle is between two adjacent cones, as would be typical, this results in fluid being directed more toward one adjacent cone and away from the other adjacent cone. It is believed that the maximum distance from the projected fluid path of the fluid column to the tip of the inserts should be 0.5 inches for a cone cleaning nozzle. In a preferred embodiment, a cone cleaning nozzle has a lateral angle of at least 6° and a clearance distance 0.5" or less. More preferably, the clearance from the fluid column centerline to the nearest insert tip should be 0.4 inches or less. It would be even more desirable to have the fluid column fluid distance be 0.3 inches or less. Moving the fluid column closer to the insert tips can significantly reduce bit balling and increase rates of penetration as long as the cone shell is not eroded beyond acceptable limits. For example, cone shell erosion to an extent that the pressed-in carbide inserts fall out of the steel cone shell should generally be avoided.

In one embodiment, each cone cleaning nozzle is a mini-extended nozzle as shown in FIG. 9. Mini-extended nozzles have the advantage that they provide higher velocity fluid at the insert tip to maximize cone cleaning and also provide for a higher impact pressure on the hole bottom. In some formations, such as those with large amounts of abrasive particles such as sand, diffuser nozzles may be preferable. In a diffuser nozzle, the fluid is slowed down within the body of the nozzle such that when it exits the nozzle bore, the fluid has a wider flow stream with a lower velocity. This allows high velocity fluid (although with significantly less velocity than when an equivalent sized mini-extended nozzle is used) to move closer to the cutter tip but at a lower velocity which will minimize any cone shell erosion while maintaining cone cleaning. In addition, a central cone cleaning nozzle may be included in a drill bit built according to the invention. For a central cone cleaning nozzle, the distance between the bit central axis to the closest cutter element is preferably less than 0.4".

In contrast to the cone cleaning nozzle, a hole cleaning nozzle ideally creates maximum or near-maximum impingement pressure on the bottom of the wellbore. This has been identified ideally as a vertical nozzle with an exit point close to the hole bottom. In the context of the invention, it was noted that regardless of how many hole cleaning nozzles are used, maximum impingement pressure on the bottom of the borehole is about the same (although at any one instant the area being covered by maximum impingement pressure may not be as large). Further, if a single hole cleaning nozzle is located on a rotating drill bit, the fluid from the hole cleaning nozzle impinges on the hole bottom at the same locations as would the fluid from three hole cleaning nozzles (because the drill string rotates) assuming that all the hole cleaning nozzles are manufactured at the same orientation. Thus, it is believed that the use of a single hole cleaning nozzle will be nearly as effective as the use of more than one bottom hole cleaning nozzle.

In a preferred embodiment, hole cleaning nozzle 37 is substantially parallel to the bit centerline 36. In the context of the invention, a bottom hole cleaning nozzle has a lateral angle of less than six degrees. Jet nozzles designed for bottom hole cleaning, such as nozzle 37, generally have small lateral angles (e.g. less than 6°) and a clearance distance greater than 0.5". Hole cleaning nozzle 37 may be a mini-extended nozzle, having a smoothly converging portion 76 at its upstream end blending into a cylindrical orifice portion 77 which helps streamline flow through the nozzle and direct a streamlined flow toward the bottom of the bore hole. It has been found that the radial angle of a hole cleaning nozzle can be substantially large and still maintain a high impingement pressure when the impingement location is directed toward the corner of the bore hole. The bore hole is rounded in the corner thus allowing for the higher radial angles on the hole cleaning nozzles while maintaining a high impingement pressure.

The definition of a cone cleaning nozzle within the scope of the invention should also include each nozzle's respective radial tilting. However, the radial tilting of the nozzles (or nozzle receptacles) preferably is defined with regard to the rows of cutting teeth on the cone shell. An absolute radial angle definition is not ideal. Instead, in each case, the projected fluid path from each inventive nozzle or nozzle receptacle falls within two bounding curves defined by the gage row of the respective cone being cleaned by the nozzle and the location on the gage row insert where it begins to cut the hole under gage. This may best be described with respect to FIGS. 12 and 15–18.

FIG. 12 illustrates a bottom view of a three-cone roller cone drill bit having three nozzles, one between each pair of adjacent roller cones. Referring now to FIG. 12, three roller cones 1201, 1202 and 1203 establish the location of three nozzles. It can be seen that in order to intermesh the teeth of the rolling cones, the placement of the teeth or cutting elements differs on the various roller cones. In particular, each roller cone includes a gage row of teeth 1210, 1220, and 1230. Each roller cone also includes a row of cutting teeth inboard of the gage row, indicated by reference numerals 1212, 1222, and 1232. It should be noted that cone 1201 also includes a row of protective inserts between rows 1210 and 1212. The primary purpose of this row of inserts is to protect the cone shell from debris. This non-cutting row may be identified by its substantially lower height as compared to the inserts on rows 1210 and 1212.

The distance between rows of teeth 1230 and 1232 is much smaller than the distance between rows of teeth 1210 and 1212. Likewise, the distance between rows of teeth 1220 and 1222 is much smaller than the distance between rows of teeth 1210 and 1212. The smaller clearance between the outboard rows of teeth on cones 1202 and 1203 makes them more prone to bit balling than the teeth on cone 1201. Nozzles 1240, 1250 are bit cleaning nozzles, preferably placed to direct fluid to a leading side of the lagging cone, as shown. This preferred design is expected to greatly reduce the effect of bit balling in soft formations, while still providing a nozzle 1260 for hole bottom cleaning. While the leading side of the lagging cone is generally considered the preferred direction, it may be advantageous to direct the bit cleaning nozzles to the trailing side of the leading cone. It is also advantageous to use only one nozzle between each set of cones to maximize the hydraulic energy each nozzle has to perform its function, whether it be bit cleaning or bottom hole cleaning. Nonetheless, the invention includes the use of two or more nozzles between one or more pairs of cones given a drill bit dome of adequate size, so long as the other criteria for the bottom hole and cone cleaning nozzles are satisfied.

Figure 15:
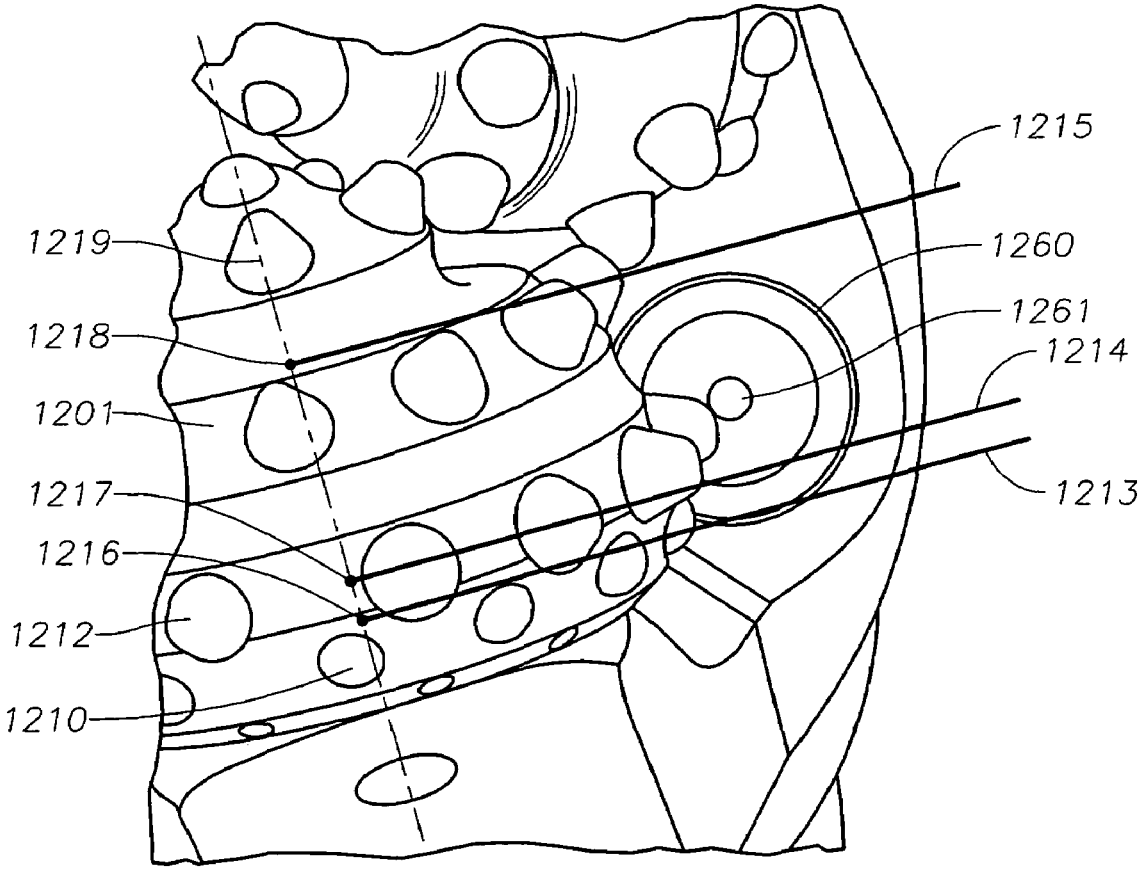
FIG. 15 is a bottom hole view showing the radial definition of a cone cleaning nozzle.

FIG. 15 is a close-up bottom view of a nozzle used to define the magnitude of radial tilting for a first nozzle according to principles of the invention. This view is orientated so that the viewing plane is perpendicular to the projected fluid path 1261. It includes nozzle 1260 with a projected fluid path centerline 1261 marked by an "x". Since the viewing plane is perpendicular to the projected fluid path centerline 1261, the centerline 1261 would be seen as a point in space that is marked by the "X". Roller cone 1201 includes cutting rows 1210 and 1212. Also shown are a projected journal axis 1219, an outer gage line 1213, an inner gage line 1214 and an inside bounding line 1215. Each of the bounding curves 1213, 1214, and 1215 pass through a projection of the corresponding point 1216, 1217, and 1218 inclusive on the viewing plane. Since points 1216, 1217 and 1218 are located on the journal axis, the projection of those points on the viewing plane will always lie on the projected journal axis. The projection of these three points are used to establish the position of the bounding curves and are called the outer gage point 1216, the inner gage point 1217 and the inside bounding point 1218. When the projected fluid path 1261 is directed toward the cone, it is desirable that the fluid pass within close proximity to either the gage row inserts 1210 or towards one of the inner rows of inserts to help remove formation that may be "sticking" to the cones. Generally, if the fluid is not directed toward the gage row 1210, it is desirable to direct the fluid toward the row of inserts 1212 just inboard of the gage row 1210 that has a primary function to crush the rock on the hole bottom. It should be understood however, that the nozzle could be directed to other inner rows on the cone if it was determined that formation adhered to the inner rows more so than the outer rows for a particular bit design and application. The radial movement of the projected fluid centerline 1261 is bounded by the inside bounding line 1215 and either the inner gage boundary line 1214 or the outer gage boundary line 1213. It is preferable that the projected fluid center line 1261 pass between the inside bounding line 1215 and the outer gage boundary line 1213 as this will allow for good cleaning of the outer inserts 1210 and 1212. If formations are very soft, it may be more preferable to have the projected fluid centerline 1261 be bounded by the inner gage boundary line 1214 to help minimize hole wall erosion, for example. Each of these lines or curves are projected onto a plane normal to the axis of the projected fluid path. The definition for the position of the bounding curves in FIG. 15 applies only in the case that the nozzle is designed for cone cleaning. These restrictions do not apply to a bottom hole cleaning nozzle.

Figure 16:
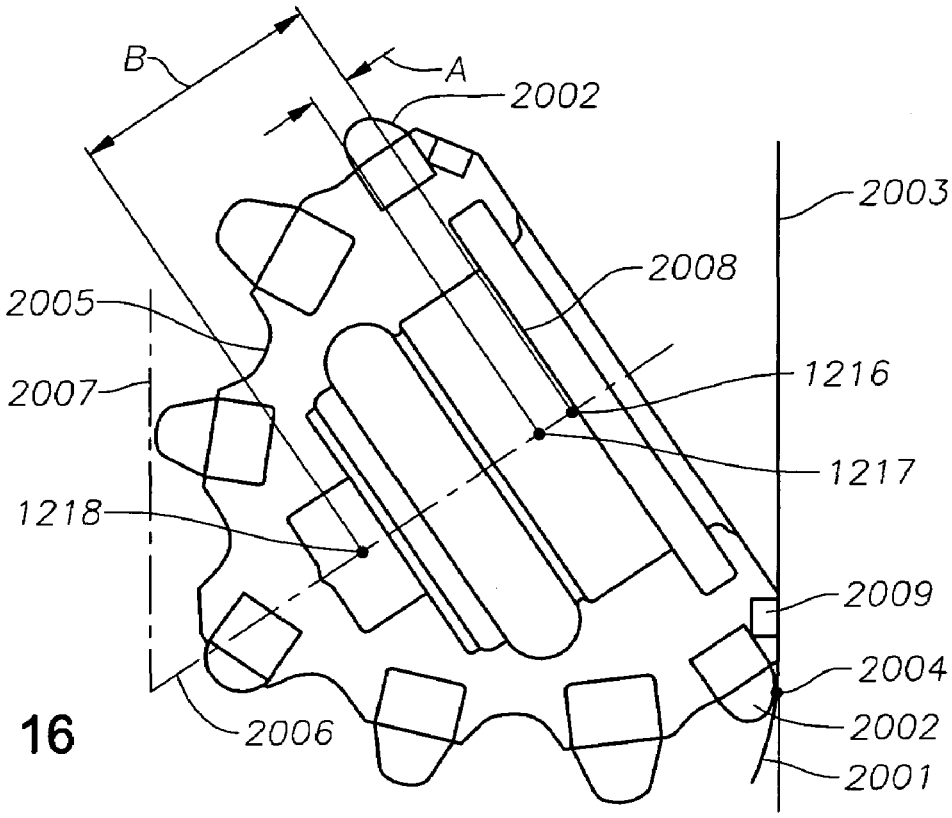
FIG. 16 is a first cut away view of a cone that defines radial references.
Figure 17:
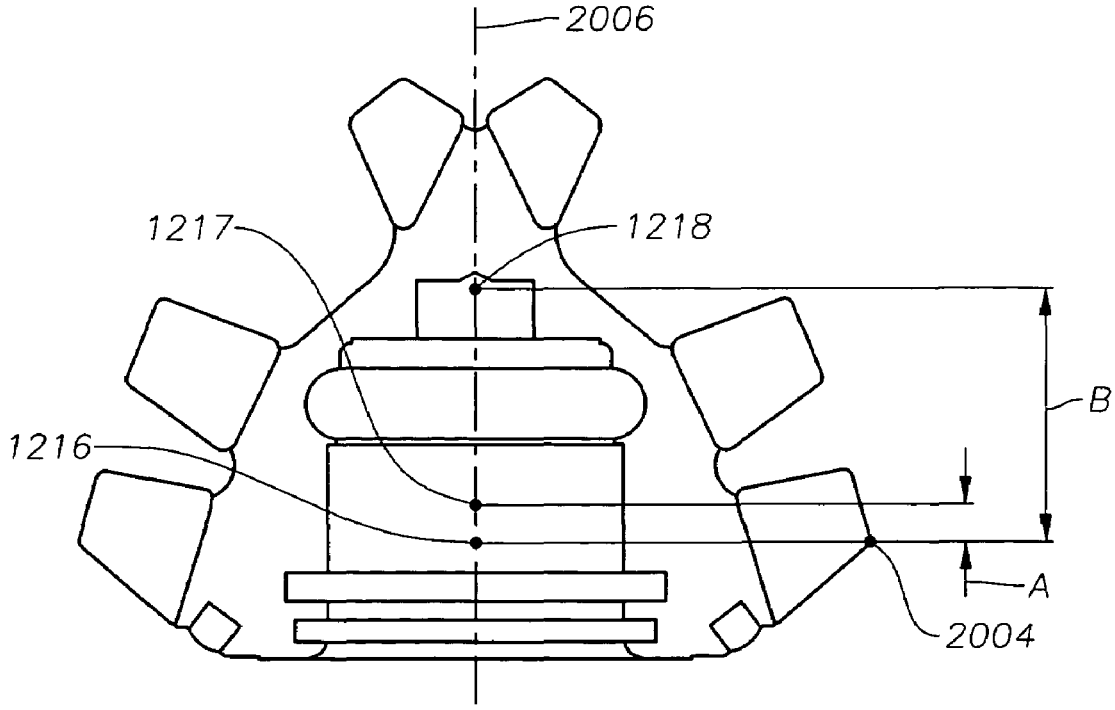
FIG. 17 is a second cut away view of a cone that defines radial references.

To identify the position of the bounding curves 1213, 1214 and 1215, the designer must first lay out the position of outer gage point 1212. FIG. 16 illustrates a layout of a cone 2005, with 5 rows of inserts that are placed around the periphery of the cone that is commonly used during the design of a bit cutting structure. The gage curve viewing plane runs through the journal axis of the cone 2006 and is oriented such that the projection of the bit centerline 2007 on the gage curve plane of reference is vertical. The gage curve 2001 is a curve which shows where a designer must place the insert to ensure that the cutters will cut the bore hole to the required diameter. As understood by those skilled in the art of designing bits and their cutting structure, a "gage curve" is commonly employed as a design tool to ensure that a bit made in accordance to a particular design will cut to the specified hole diameter. The gage curve is a complex mathematical formulation which, based upon the parameters of bit diameter, journal angle, and journal offset, takes all the points that will cut the specified hole size, as located in three dimensional space, and projects these points into a two-dimensional plane which contains the journal centerline and is parallel to the bit axis. It should be noted that the gage curve plane does not pass through the centerline of the bit unless the bit has an offset of 0.0 inches. The use of the gage curve greatly simplifies the bit design process as it allows the gage cutting elements to be accurately located in two dimensional space which is easier to visualize. The gage curve, however, should not be confused with the cutting path of any individual cutting element as described previously. Any part of an insert with lies on the gage curve will thus cut the hole at the gage diameter 2003. Any insert on the cone that is seen inboard of the gage curve 2001 will always cut inboard of the gage diameter 2003. The gage row 2002 is designed to cut the bore to the gage diameter with the insert surfaces that lie on the gage curve 2001. A gage point 2004 is defined as the location on a gage row insert 2002 where the insert transitions from cutting gage to being inboard of the gage curve 2001. The outer gage point 1216 is located at the intersection of the cone bore axis 2006 and line 2008 which is perpendicular to the cone bore axis 2006 and passes through the gage point 2004. The inner gage point 1217 is found at a distance "A" along the cone bore axis 2006 from the outer gage point 1216 where "A" is defined as 0.03*bit diameter. The inside bounding point 1218 is found at a distance "B" along the cone bore axis 2006 from the outer gage point 1216 where "B" is defined as 0.20*bit diameter. For example, on a 7.875" bit, the distance "A" is 0.03*7.875=0.236 and the distance "B"=0.20*7.875=1.575. If the same insert, insert position and insert orientation are used on all cones, then the bounding lines will be in the same position relative to each cone. However, if different inserts or insert positions or insert orientation are used then the bounding lines may have different positions relative to each cone. While FIG. 16 shows an insert cone, the same definitions work for a milltooth cone as shown in FIG. 17. Even though the gage curve is not shown, the gage point 2004, the outer gage point 1216, the inner gage point 1217 and the inside boundary point 1218 are shown.

In some cutting structure designs, multiple inserts will touch the gage curve. FIG. 16 has two insert rows that touch the gage curve 2001, the gage row inserts 2002 and the heel row insert 2009. Since maintaining gage is important in drilling applications, sometimes 3 rows of inserts or more on a single cone will touch the gage curve to prolong the time that the bit will maintain a gaged hole. In these instances, the row of inserts that are furthest down the gage curve are used to determine the gage point 2004 as shown in FIG. 16.

It should be noted that the two-dimensional measured distance between points 1216, 1217 and 1218 as seen in FIG. 15 will generally be smaller than the true distances as shown in FIGS. 20 and 21 since the cone bore axis 1219 is usually inclined to the viewing plane in those figures. By definition of that gage curve view, the cone bore axis 2006 is always parallel to the viewing planes of FIGS. 20 and 21.

Looking at FIG. 15, cone 1201 is the cone of interest since the projected fluid centerline 1261 passes closest to the inserts of this cone. The bounding curves of FIG. 15 may be defined as follows:

1. Select a cone of interest and lay it out in a gage curve view as shown in FIG. 16 or its equivalent with a gage curve 2001 to indicate where the gage row insert 2002 will cut the gage.
2. Create a gage point 2004 on the outline of the gage row insert where the insert begins to move away from the gage curve 2001.
3. Create an outer gage point 1216 at the intersection of the cone bore axis 2006 and a line 2008 perpendicular to the cone bore axis 2006 that passes through the gage point 2004.
4. Create an inner gage point 1217 at a distance along the cone bore axis equal to 0.03*bit diameter.
5. Create an inside bounding point 1218 at a distance along the cone bore axis equal to 0.20*bit diameter.
6. Referring to FIG. 15, in a view that is perpendicular to the projected fluid path 1261 draw an outer gage boundary line 1213 through the projection of the outer gage point 1216 on the projected bore axis 1219 and perpendicular to the projected cone bore axis 1219. The viewing plane of FIG. 15 may be offset from the nozzle bore at any distance. However, it may be preferred to offset the plane such that it hovers slightly above the cone of interest for viewing purposes.
7. Draw an inner gage boundary line 1214 through the projection of the inner gage point 1217 on the projected bore axis 1219 and perpendicular to the projected cone bore axis 1219.
8. Draw an inside boundary line 1215 through the projection of the inside boundary point 1218 on the projected bore axis 1219 and perpendicular to the projected cone bore axis 1219.
9. Repeat steps one through eight for each nozzle set up as a cone cleaning nozzle.

The hole cleaning nozzle orifice exit 57 preferably is sufficiently to the hole bottom for optimal cleaning. It is generally accepted in the industry that a nozzle exit should stand approximately 6 to 10 nozzle diameters off the formation for optimal cleaning. This allows the jet streamlines to develop for optimal cleaning and impingement pressure on the hole bottom. While this is the goal of the designer, extension to the hole bottom will likely be impede by the cone inserts which extend outward toward any nozzle extensions between the cone. Thus, the lower end of the hole cleaning nozzle 37 is preferably placed within 6 to 10 nozzle diameters from the hole bottom while still leaving sufficient clearance between the nozzle 37 and cutting elements to prevent breakage of either component and/or prevent the cutter cones from locking up.

Figure 18:
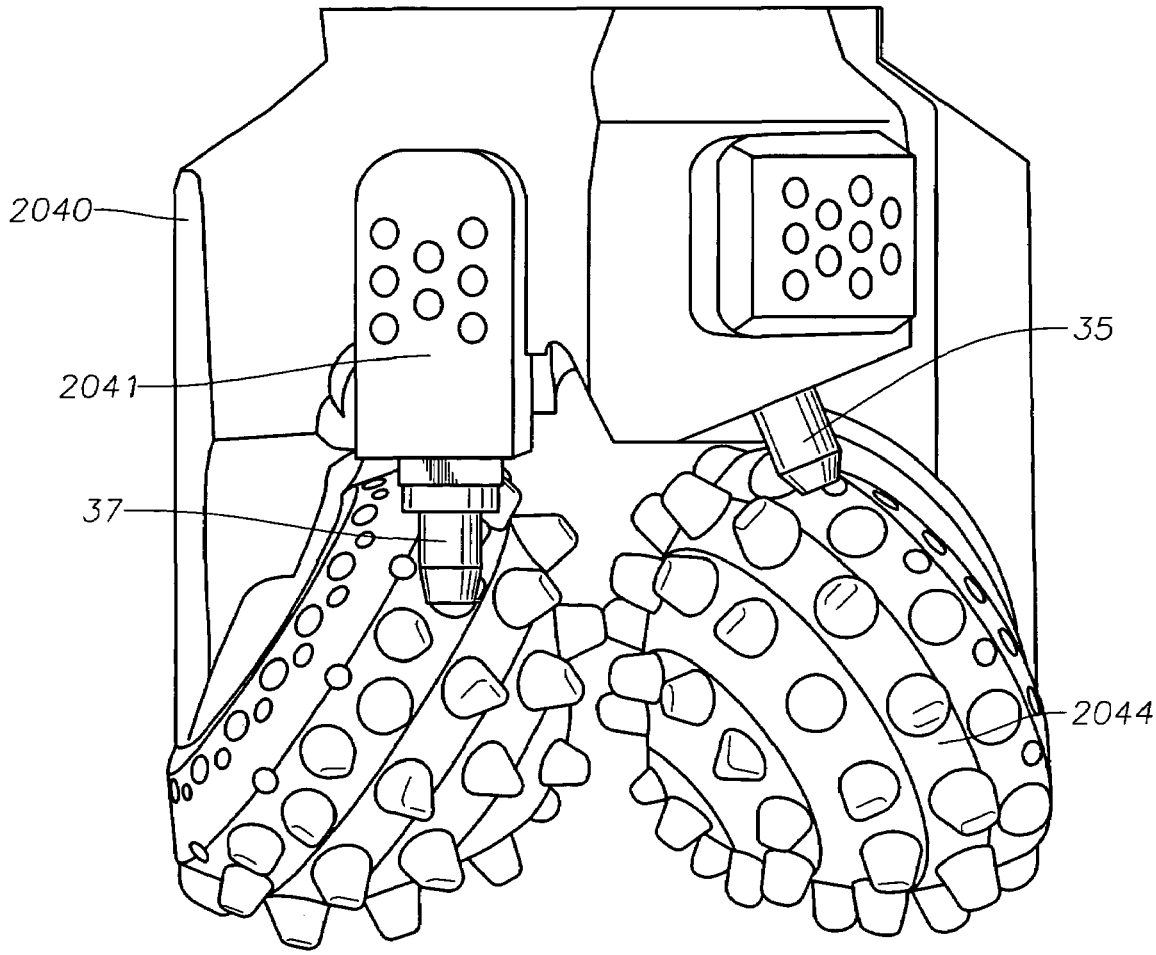
FIG. 18 is a side view of a drill bit showing a two-cone bit having at least one bit cleaning nozzle and one hole cleaning nozzle.

While a three-cone bit having two bit cleaning nozzles and one hole cleaning nozzle has been described, a variety of alternate configurations have been contemplated. For example, FIG. 18 shows an embodiment with a two-cone bit 2040 having at least one bit cleaning nozzle 35 to clean cone 2044 and one hole cleaning nozzle 37. Two-cone bits are particularly well suited to allow nozzle extension to the hole bottom since there is significantly more space between the cones than is available on three cone bits. This two-cone bit utilizes an extended nozzle tube 2041 that is an attachable body that is welded into the bit and a mini-extended nozzle 37 to significantly increase the extension to the hole bottom. In an alternate embodiment, a two-cone bit having four bit cleaning nozzles 35 and one hole cleaning nozzle 37 is preferred. As alluded to above, the four bit cleaning nozzles 35 are located on one dome 18, while the hole cleaning nozzle 37 is located on the other dome 18.

While preferred embodiments of this invention have been shown and described, modification thereof can be made by one skilled in the art without departing from the spirit or teaching of this invention. The embodiments described herein are exemplary only and are not limiting. Many variations and modifications of the compositions and methods are possible and are within the scope of this invention. For example, multiple sets of bit cleaning nozzles 35 or hole cleaning nozzles 37 may be located between the same two cones. This becomes more feasible on larger drill bits where the area of if the dome is increased. Accordingly, the scope of protection is not limited to the embodiments described herein, but is only limited by the claims, the scope of which shall include all equivalents of the subject matter of the claims.

What is claimed is:

1. A drill bit, comprising:

a bit body with a bit central axis and defining a gage diameter;

a first roller cone, attached to said bit body, having a cone shell, a journal axis, a gage curve, a first set of cutting elements that cut to said gage diameter and a second set of cutting elements that cut inside said gage diameter, there being a gage point at the intersection of said gage curve and at least one of said first set of cutting elements;

at least a second roller cone attached to said bit body, having a cone shell, a journal axis, a third set of cutting elements that cut to said gage diameter, and a forth set of cutting elements that cut inside of the gage diameter;

a first nozzle receptacle formed by said bit body and closer to said gage diameter than to said central axis, said first nozzle receptacle forming a first centroid and a first projected fluid path;

a lateral angle for said first projected fluid path defined with respect to a first plane, said first plane being defined by said bit body central axis, and by a first line lying parallel to said bit body central axis and intersecting said first centroid, wherein said first projected fluid path is disposed at an angle of at most a magnitude of six degrees to said first plane; and a second nozzle receptacle formed by said bit body and closer to said gage diameter than to said central axis, said second nozzle receptacle forming a second centroid and a second projected fluid path;

a lateral angle for said second projected fluid path defined with respect to a second plane, said second plane being defined by said bit body central axis, and by a second line lying parallel to said bit body central axis and intersecting said second centroid, wherein said second projected fluid path is disposed at an angle of at least a magnitude of six degrees to said second plane;

a radial angle for said second projected fluid path defined with respect to at least two bounding lines, said second projected fluid path being directed between an outer gage boundary line and an inside boundary line;

said outer gage boundary line being defined in a viewing plane perpendicular to said second projected fluid path where said outer gage boundary line is perpendicular to the projection of said journal axis for said first roller cone on said viewing plane, and intersects said projected journal axis at a point of projection of an outer gage point on said viewing plane, said outer gage point being disposed at the intersection of said journal axis and a line perpendicular to said journal axis extending through said gage point;

said inside boundary line being defined in said viewing plane where said inside boundary line is perpendicular to said projected journal axis and intersects said projected journal axis at a projection of an inside bounding point on said viewing plane, said inside bounding point being disposed along said journal axis at a distance equal to 20 percent of said gage diameter from said outer gage point toward said bit body central axis.

2. The drill bit of claim 1, wherein an inner gage boundary line is defined in said viewing plane where said inner gage boundary line is perpendicular to said projected journal axis and intersects said projected journal axis at a projection of an inner gage point on said viewing plane, said inner gage point being disposed along said journal axis at a distance equal to 3 percent of said gage diameter from said outer gage point toward said bit body central axis and where said second projected fluid path passes between said inner gage boundary line and said inside boundary line.

3. The drill bit of claim 2, wherein said second projected fluid path is closer to at least one of the tips of the cutting elements of said first cone at its closest than to any of the tips of the cutting elements of said second cone at their closest, said second projected fluid path being within 0.5 inches of at least one of said cutting tips on said first cone at its closest.

4. The drill bit of claim 3, wherein, said second projected fluid path is a face normal fluid path.

5. The drill bit of claim 3, wherein, said second projected fluid path is a parallel to nozzle centerline fluid path.

6. The drill bit of claim 3, wherein, said second projected fluid path is a projected average fluid path.

7. The drill bit of claim 3, wherein said second projected fluid path is closer to said second set of cutting elements than to said first set of cutting elements when measured with their minimum distances.

8. The drill bit of claim 2, wherein, an at least third projected fluid path is oriented as a bit cleaning nozzle.

9. The drill bit a claim 2 wherein, at least a third projected fluid path is oriented as a hole cleaning nozzle.

10. The drill bit of claim 2, wherein said second projected fluid path is closer to at least one of the tips of the cutting elements of said first cone at it closest than to any of the tips of the cutting elements of said second cone at their closest, said second projected fluid path being within 0.4 inches of at least one of said cutting tips on said first cone at its closest.

11. The drill bit of claim 10, wherein said second projected fluid path is a face normal fluid path.

12. The drill bit of claim 10, wherein said second projected fluid path is a parallel to nozzle centerline fluid path.

13. The drill bit of claim 10, wherein said second projected fluid path is a projected average fluid path.

14. The drill bit of claim 10, wherein said second projected fluid path is closer to said second set of cutting elements than to said first set of cutting elements when measured with their minimum distances.

15. The drill bit of claim 2, wherein said second projected fluid path is closer to at one of the tips of the cutting elements of said first cone at its closest than to any of the cutting elements of said cone at their closest, said second projected fluid path being within 0.3 inches of at least one of said cutting tips on said first cone at its closest.

16. The drill bit of claim 15, wherein, said second projected fluid path is a face normal fluid path.

17. The drill bit of claim 15, wherein said second projected fluid path is a parallel to nozzle centerline fluid path.

18. The drill bit of claim 15, wherein, said second projected fluid path is a projected average fluid path.

19. The drill bit of claim 13, wherein, said second projected fluid path is closer to said second set of cutting elements than to said first set of cutting elements when measured with their minimum distances.

20. The drill bit of claim 1, wherein said first projected fluid path is parallel with said bit central axis.

21. The drill bit of claim 1 wherein, no more than one nozzle receptacle that is closer to the said gage diameter than to said bit axis, resides between any pair of adjacent roller cones on said bit body.

22. The drill bit of claim 1 wherein, said second lateral angle is greater than eight degrees.

23. The drill bit of claim 1 wherein, said second lateral angle is less than a minus eight degrees.

24. The drill bit of claim 1, wherein, said first projected fluid path is a face normal fluid path.

25. The drill bit of claim 1, wherein, said first projected fluid path is a parallel to nozzle centerline fluid path.

26. The drill bit of claim 1, wherein, said first projected fluid path is a projected average fluid path.

27. The drill bit of claim 1, wherein said second projected fluid path is closer to at least one of the tips of the cutting elements of said first cone at its closest than to any of the tips of the cutting elements of said second cone at their closest, said second projected fluid path being within 0.5 inches of at least one of said cutting tips on said first cone at its closest.

28. The drill bit of claim 27, wherein, said second projected fluid path is a face normal fluid path.

29. The drill bit of claim 28, wherein, said second projected fluid path is a face normal fluid path.

30. The drill bit of claim 28, wherein, said second projected fluid path is a parallel to nozzle centerline fluid path.

31. The drill bit of claim 28, wherein, said second projected fluid path is a projected average fluid path.

32. The drill bit of claim 28, wherein said second projected fluid path is closer to said second set of cutting elements than to said first set of cutting elements when measured with their minimum distances.

33. The drill bit of claim 27, wherein, said second projected fluid path is a parallel to nozzle centerline fluid path.

34. The drill bit of claim 27, wherein, said second projected fluid path is a projected average fluid path.

35. The drill bit of claim 27, wherein said second projected fluid path is closer to said second set of cutting elements than to said first set of cutting elements when measured with their minimum distances.

36. The drill bit of claim 1, wherein said second projected fluid path is closer to at least one of the tips of the cutting elements of said first cone at it closest than to any of the tips of the cutting elements of said second cone at their closest, said second projected fluid path being within 0.4 inches of at least one of said cutting tips on said first cone at its closest.

37. The drill bit of claim 36, wherein, said second projected fluid path is a face normal fluid path.

38. The drill bit of claim 36, wherein, said second projected fluid path is a parallel to nozzle centerline fluid path.

39. The drill bit of claim 36, wherein, said second projected fluid path is a projected average fluid path.

40. The drill bit of claim 36, wherein said second projected fluid path is closer to said second set of cutting elements than to said first set of cutting elements when measured with their minimum distances.

41. The drill bit of claim 1, wherein, said nozzle receptacle in located in an attachable body.

42. The drill bit of claim 41, wherein, said attachable body is welded to said bit body.

43. The drill bit of claim 1, wherein, an at least third projected fluid path is oriented as a bit cleaning nozzle.

44. The drill bit a claim 1 wherein, at least a third projected fluid path is oriented as a hole cleaning nozzle.

45. The drill bit of claim 1, wherein said second projected fluid path is closer to at least one of the tips of the cutting elements of said first cone at its closest than to any of the cutting elements of said second cone at their closest, said second projected fluid path being within 0.3 inches of at least one of said cutting tips on said first cone at its closest.

46. A drill bit, comprising:

a bit body with a bit central axis and defining a gage diameter;

a first roller cone, attached to said bit body, having a cone shell, a journal axis, a gage curve, a first set of cutting elements that cut to said gage diameter and a second set of elements that cut inside said gage diameter, there being a gage point at the intersection of said gage curve and at least one of said first set of cutting elements;

at least a second roller cone attached to said bit body, having a cone shell, a journal axis, a third set of cutting elements that cut to said gage diameter, and a forth set of elements that cut inside of the gage diameter;

a first nozzle receptacle formed by said bit body and closer to said gage diameter than to said central axis, said first nozzle receptacle forming a first centroid and a first projected fluid path;

a lateral angle for said first projected fluid path defined with respect to a first plane, said first plane being defined by said bit body central axis, and by a first line lying parallel to said bit body central axis and intersecting said first centroid, wherein said first projected fluid path is disposed at an angle of at most a magnitude of six degrees to said first plane; and a second nozzle receptacle formed by said bit body and closer to said gage diameter than to said central axis, said second nozzle receptacle forming a second centroid and a second projected fluid path;

a lateral angle for said second projected fluid path defined with respect to a second plane, said second plane being defined by said bit body central axis, and by a second line lying parallel to said bit body central axis and intersecting said second centroid, wherein said second projected fluid path is disposed at an angle of at least a magnitude of eight degrees to said second plane;

a radial angle for said second projected fluid path defined with respect to at least two bounding lines, said second projected fluid path being directed between an outer gage boundary line and an inside boundary line;

said outer gage boundary line being defined in a viewing plane perpendicular to said second projected fluid path where said outer gage boundary line is perpendicular to the projection of said journal axis for said first roller cone on said viewing plane, and intersects said projected journal axis at a point of projection of an outer gage point on said viewing plane, said outer gage point being disposed at the intersection of said journal axis and a line perpendicular to said journal axis extending through said gage point;

said inside boundary line being defined in said viewing plane where said inside boundary line is perpendicular to said projected journal axis and intersects said projected journal axis at a projection of an inside bounding point on said viewing plane, said inside bounding point being disposed along said journal axis at a distance equal to 20 percent of said gage diameter from said outer gage point toward said bit body central axis.

47. The drill bit of claim 46, wherein an inner gage boundary line is defined in said viewing plane where said inner gage boundary line is perpendicular to said projected journal axis and intersects said projected journal axis at a projection of an inner gage point on said viewing plane, said inner gage point being disposed along said journal axis at a distance equal to 3 percent of said gage diameter from said outer gage point toward said bit body central axis and where said second projected fluid path passes between said inner gage boundary line and said inside boundary line.

48. The drill bit of claim 47, wherein said second projected fluid path is closer to at least one of the tips of the cutting elements of said first cone at its closest than to any of the tips of the cutting elements of said second cone at their closest, said second projected fluid path being within 0.5 inches of at least one of said cutting tips on said first cone at its closest.

49. The drill bit of claim 48, wherein, said second projected fluid path is a face normal fluid path.

50. The drill bit of claim 48, wherein, said second projected fluid path is a parallel to nozzle centerline fluid path.

51. The drill bit of claim 48, wherein, said second projected fluid path is a projected average fluid path.

52. The drill bit of claim 48, wherein said second projected fluid path is closer to said second set of cutting elements than to said first set of cutting elements when measured with their minimum distances.

53. The drill bit of claim 47, wherein, an at least third projected fluid path is oriented as a bit cleaning nozzle.

54. The drill bit a claim 47 wherein, at least a third projected fluid path is oriented as a hole cleaning nozzle.

55. The drill bit of claim 47, wherein said second projected fluid path is closer to at least one of the tips of the cutting elements of said first cone at it closest than to any of the tips of the cutting elements of said second cone at their closest, said second projected fluid path being within 0.4 inches of at least one of said cutting tips on said first cone at its closest.

56. The drill bit of claim 55, wherein, said second projected fluid path is a face normal fluid path.

57. The drill bit of claim 55, wherein, said second projected fluid path is a parallel to nozzle centerline fluid path.

58. The drill bit of claim 55, wherein, said second projected fluid path is a projected average fluid path.

59. The drill bit of claim 55, wherein said second projected fluid path is closer to said second set of cutting elements than to said first set of cutting elements when measured with their minimum distances.

60. The drill bit of claim 47, wherein said second projected fluid path is closer to at least one of the tips of the cutting elements of said first cone at its closest than to any of the cutting elements of said second cone at their closest, said second projected fluid path being within 0.3 inches of at least one of said cutting tips on said first cone at its closest.

61. The drill bit of claim 60, wherein, said second projected fluid path is a face normal fluid path.

62. The drill bit of claim 60, wherein, said second projected fluid path is a parallel to nozzle centerline fluid path.

63. The drill bit of claim 60, wherein, said second projected fluid path is a projected average fluid path.

64. The drill bit of claim 60, wherein said second projected fluid path is closer to said second set of cutting elements than to said first set of cutting elements when measured with their minimum distances.

65. The drill bit of claim 46, wherein said first projected fluid path is parallel with said bit central axis.

66. The drill bit of claim 46 wherein, no more than one nozzle receptacle, that is closer to the said gage diameter than to said bit axis, resides between any pair of adjacent roller cones on said bit body.

67. The drill bit of claim 46 wherein, said second lateral angle is greater than eight degrees.

68. The drill bit of claim 46 wherein, said second lateral angle is less than a minus eight degrees.

69. The drill bit of claim 46, wherein, said first projected fluid path is a face normal fluid path.

70. The drill bit of claim 46, wherein, said first projected fluid path is a parallel to nozzle centerline fluid path.

71. The drill bit of claim 46, wherein, said first projected fluid path is a projected average fluid path.

72. The drill bit of claim 46, wherein said second projected fluid path is closer to at least one of the tips of the cutting elements of said first cone at its closest than to any of the tips of the cutting elements of said second cone at their closest, said second projected fluid path being within 0.5 inches of at least one of said cutting tips on said first cone at its closest.

73. The drill bit of claim 72, wherein, said second projected fluid path is a face normal fluid path.

74. The drill bit of claim 72, wherein, said second projected fluid path is a parallel to nozzle centerline fluid path.

75. The drill bit of claim 72, wherein, said second projected fluid path is a projected average fluid path.

76. The drill bit of claim 72, wherein said second projected fluid path is closer to said second set of cutting elements than to said first set of cutting elements when measured with their minimum distances.

77. The drill bit of claim 46, wherein said second projected fluid path is closer to at least one of the tips of the cutting elements of said first cone at it closest than to any of the tips of the cutting elements of said second cone at their closest, said second projected fluid path being within 0.4 inches of at least one of said cutting tips on said first cone at its closest.

78. The drill bit of claim 77, wherein, said second projected fluid path is a face normal fluid path.

79. The drill bit of claim 77, wherein, said second projected fluid path is a parallel to nozzle centerline fluid path.

80. The drill bit of claim 78, wherein, said second projected fluid path is a projected average fluid path.

81. The drill bit of claim 77, wherein said second projected fluid path is closer to said second set of cutting elements than to said first set of cutting elements when measured with their minimum distances.

82. The drill bit of claim 46, wherein said second projected fluid path is closer to at least one of the tips of the cutting elements of said first cone at its closest than to any of the cutting elements of said second cone at their closest, said second projected fluid path being within 0.3 inches of at least one of said cutting tips on said first cone at its closest.

83. The drill bit of claim 82, wherein, said second projected fluid path is a face normal fluid path.

84. The drill bit of claim 82, wherein, said second projected fluid path is a parallel to nozzle centerline fluid path.

85. The drill bit of claim 82, wherein, said second projected fluid path is a projected average fluid path.

86. The drill bit of claim 82, wherein said second projected fluid path is closer to said second set of cutting elements than to said first set of cutting elements when measured with their minimum distances.

87. The drill bit of claim 46, wherein, said nozzle receptacle in located in an attachable body.

88. The drill bit of claim 87, wherein, said attachable body is welded to said bit body.

89. The drill bit of claim 46, wherein, an at least third projected fluid path is oriented as a bit cleaning nozzle.

90. The drill bit a claim 46 wherein, at least a third projected fluid path is oriented as a hole cleaning nozzle.

91. A drill bit, comprising:

a bit body with a bit central axis and defining a gage diameter;

a first roller cone, attached to said bit body, having a cone shell, a journal axis, a gage curve, a first set of cutting elements that cut to said gage diameter and a second set of elements that cut inside said gage diameter, there being a gage point at the intersection of said gage curve and at least one of said first set of cutting elements;

an at least second roller cone attached to said bit body, having a cone shell, a journal axis, and third set of cutting elements that cut to said gage diameter and a forth set of elements that cut inside of the gage diameter;

a first nozzle receptacle formed by said bit body and closer to said gage diameter than to said central axis, said first nozzle receptacle forming a first centroid and a first projected fluid path;

a lateral angle for said first projected fluid path defined with respect to a first plane, said first plane being defined by said bit body central axis, and by a first line lying parallel to said bit body central axis and intersecting said first centroid, wherein said first projected fluid path is disposed at an angle of at most a magnitude of six degrees to said first plane; and a second nozzle receptacle formed by said bit body and closer to said gage diameter than to said central axis, said second nozzle receptacle forming a second centroid and a second projected fluid path;

a lateral angle for said second projected fluid path defined with respect to a second plane, said second plane being defined by said bit body central axis, and by a second line lying parallel to said bit body central axis and intersecting said second centroid, wherein said second projected fluid path is disposed at an angle of at least a magnitude often degrees to said second plane;

a radial angle for said second projected fluid path defined with respect to at least two bounding lines, said second projected fluid path being directed between an outer gage boundary line and an inside boundary line;

said outer gage boundary line being defined in a viewing plane perpendicular to said second projected fluid path where said outer gage boundary line is perpendicular to the projection of said journal axis for said first roller cone on said viewing plane, and intersects said projected journal axis at a point of projection of an outer gage point on said viewing plane, said outer gage point being disposed at the intersection of said journal axis and a line perpendicular to said journal axis extending through said gage point;

said inside boundary line being defined in said viewing plane where said inside boundary line is perpendicular to said projected journal axis and intersects said projected journal axis at a projection of an inside bounding point on said viewing plane, said inside bounding point being disposed along said journal axis at a distance equal to 20 percent of said gage diameter from said outer gage point toward said bit body central axis.

92. The drill bit of claim 91, wherein an inner gage boundary line is defined in said viewing plane where said inner gage boundary line is perpendicular to said projected journal axis and intersects said projected journal axis at a projection of an inner gage point on said viewing plane, said inner gage point being disposed along said journal axis at a distance equal to 3 percent of said gage diameter from said outer gage point toward said bit body central axis and where the second projected fluid path passes between said inner gage boundary line and said inside boundary line.

93. The drill bit of claim 92, wherein said second projected fluid path is closer to at least one of the tips of the cutting elements of said first cone at its closest than to any of the tips of the cutting elements of said second cone at their closest, said second projected fluid path being within 0.5 inches of at least one of said cutting tips on said first cone at its closest.

94. The drill bit of claim 93, wherein, said second projected fluid path is a face normal fluid path.

95. The drill bit of claim 93, wherein, said second projected fluid path is a parallel to nozzle centerline fluid path.

96. The drill bit of claim 93, wherein, said second projected fluid path is a projected average fluid path.

97. The drill bit of claim 93, wherein said second projected fluid path is closer to said second set of cutting elements than to said first set of cutting elements when measured with their minimum distances.

98. The drill bit of claim 92, wherein, an at least third projected fluid path is oriented as a bit cleaning nozzle.

99. The drill bit a claim 92 wherein, at least a third projected fluid path is oriented as a hole cleaning nozzle.

100. The drill bit of claim 92, wherein said second projected fluid path is closer to at least one of the tips of the cutting elements of said first cone at it closest than to any of the tips of the cutting elements of said second cone at their closest, said second projected fluid path being within 0.4 inches of at least one of said cutting tips on said first cone at its closest.

101. The drill bit of claim 100, wherein, said second projected fluid path is a face normal fluid path.

102. The drill bit of claim 100, wherein, said second projected fluid path is a parallel to nozzle centerline fluid path.

103. The drill bit of claim 100, wherein, said second projected fluid path is a projected average fluid path.

104. The drill bit of claim 88, wherein said second projected fluid path is closer to said second set of cutting elements than to said first set of cutting elements when measured with their minimum distances.

105. The drill bit of claim 92, wherein said second projected fluid path is closer to at least one of the tips of the cutting elements of said first cone at its closest than to any of the cutting elements of said second cone at their closest, said second projected fluid path being within 0.3 inches of at least one of said cutting tips on said first cone at its closest.

106. The drill bit of claim 105, wherein, said second projected fluid path is a face normal fluid path.

107. The drill bit of claim 105, wherein, said second projected fluid path is a parallel to nozzle centerline fluid path.

108. The drill bit of claim 105, wherein, said second projected fluid path is a projected average fluid path.

109. The drill bit of claim 105, wherein said second projected fluid path is closer to said second set of cutting elements than to said first set of cutting elements when measured with their minimum distances.

110. The drill bit of claim 91, wherein said first projected fluid path is parallel with said bit central axis.

111. The drill bit of claim 91 wherein, no more than one nozzle receptacle that is closer to the said gage diameter than to said bit axis, resides between any pair of adjacent roller cones on said bit body.

112. The drill bit of claim 91 wherein, said second lateral angle is greater than eight degrees.

113. The drill bit of claim 91 wherein, said second lateral angle is less than a minus eight degrees.

114. The drill bit of claim 91, wherein, said first projected fluid path is a face normal fluid path.

115. The drill bit of claim 91, wherein, said first projected fluid path is a parallel to nozzle centerline fluid path.

116. The drill bit of claim 91, wherein, said first projected fluid path is a projected average fluid path.

117. The drill bit of claim 91, wherein said second projected fluid path is closer to at least one of the tips of the cutting elements of said first cone at its closest than to any of the tips of the cutting elements of said second cone at their closest, said second projected fluid path being within 0.5 inches of at least one of said cutting tips on said first cone at its closest.

118. The drill bit of claim 117, wherein, said second projected fluid path is a face normal fluid path.

119. The drill bit of claim 117, wherein, said second projected fluid path is a parallel to nozzle centerline fluid path.

120. The drill bit of claim 117, wherein, said second projected fluid path is a projected average fluid path.

121. The drill bit of claim 117, wherein said second projected fluid path is closer to said second set of cutting elements than to said first set of cutting elements when measured with their minimum distances.

122. The drill bit of claim 91, wherein said second projected fluid path is closer to at least one of the tips of the cutting elements of said first cone at it closest than to any of the tips of the cutting elements of said second cone at their closest, said second projected fluid path being within 0.4 inches of at least one of said cutting tips on said first cone at its closest.

123. The drill bit of claim 122, wherein, said second projected fluid path is a face normal fluid path.

124. The drill bit of claim 122, wherein, said second projected fluid path is a parallel to nozzle centerline fluid path.

125. The drill bit of claim 122, wherein, said second projected fluid path is a projected average fluid path.

126. The drill bit of claim 122, wherein said second projected fluid path is closer to said second set of cutting elements than to said first set of cutting elements when measured with their minimum distances.

127. The drill bit of claim 91, wherein said second projected fluid path is closer to at least one of the tips of the cutting elements of said first cone at its closest than to any of the cutting elements of said second cone at their closest, said second projected fluid path being within 0.3 inches of at least one of said cutting tips on said first cone at its closest.

128. The drill bit of claim 127, wherein, said second projected fluid path is a face normal fluid path.

129. The drill bit of claim 127, wherein, said second projected fluid path is a parallel to nozzle centerline fluid path.

130. The drill bit of claim 127, wherein, said second projected fluid path is a projected average fluid path.

131. The drill bit of claim 127, wherein said second projected fluid path is closer to said second set of cutting elements than to said first set of cutting elements when measured with their minimum distances.

132. The drill bit of claim 91, wherein, said nozzle receptacle in located in an attachable body.

133. The drill bit of claim 132, wherein, said attachable body is welded to said bit body.

134. The drill bit of claim 91, wherein, an at least third projected fluid path is oriented as a bit cleaning nozzle.

135. The drill bit a claim 91 wherein, at least a third projected fluid path is oriented as a hole cleaning nozzle.

* * * * *